US011170717B2

(12) United States Patent
Wang

(10) Patent No.: US 11,170,717 B2
(45) Date of Patent: Nov. 9, 2021

(54) VOLTAGE COMPENSATION METHOD AND APPARATUS, AND DISPLAY DEVICE

(71) Applicant: BOE Technology Group Co., Ltd., Beijing (CN)

(72) Inventor: Yu Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 1 day.

(21) Appl. No.: 16/655,399

(22) Filed: Oct. 17, 2019

(65) Prior Publication Data

US 2020/0193906 A1 Jun. 18, 2020

(30) Foreign Application Priority Data

Dec. 14, 2018 (CN) ..... 201811536675.2

(51) Int. Cl.
*G09G 3/3258* (2016.01)

(52) U.S. Cl.
CPC ... *G09G 3/3258* (2013.01); *G09G 2310/0243* (2013.01); *G09G 2310/0264* (2013.01)

(58) Field of Classification Search
None
See application file for complete search history.

(56) References Cited

U.S. PATENT DOCUMENTS 9,530,349 B2 * 12/2016 Chaji ..... G09G 3/3258
2013/0147694 A1 * 6/2013 Kim ..... G09G 3/3659 345/82
2013/0162617 A1 * 6/2013 Yoon ..... G09G 3/3233 345/211
2016/0275860 A1 * 9/2016 Wu ..... G09G 3/006
2017/0004764 A1 1/2017 Kim et al.
2020/0020277 A1 * 1/2020 Lee ..... H01L 51/5206

FOREIGN PATENT DOCUMENTS

| | | | |
|---|---|---|---|
| CN | 103177685 | A | 6/2013 |
| CN | 103760725 | A | 4/2014 |
| CN | 106328062 | A | 1/2017 |
| CN | 106856086 | A | 6/2017 |
| CN | 107507574 | A | 12/2017 |
| CN | 108510922 | A | 9/2018 |
| CN | 108877686 | A | 11/2018 |
| GB | 2535935 | A | 8/2016 |

OTHER PUBLICATIONS

First office action of Chinese application No. 201811536675.2 dated Mar. 17, 2020.

* cited by examiner

*Primary Examiner* — Duane N Taylor, Jr.
(74) *Attorney, Agent, or Firm* — Fay Sharpe LLP

(57) ABSTRACT

A voltage compensation method and apparatus, and a display device are provided. The method includes: acquiring an initial parameter value of a charging parameter of a first pixel circuit in a first pixel unit when the display panel is in a non-operating state; acquiring a plurality of target parameter values of the charging parameter of the first pixel circuit when the display panel is in an operating state; determining a target loading value; and adjusting the driving voltage based on the target loading value to compensate for the driving voltage.

20 Claims, 16 Drawing Sheets

VOLTAGE COMPENSATION METHOD AND APPARATUS, AND DISPLAY DEVICE

CROSS-REFERENCE TO RELATED APPLICATION

This application claims priority to Chinese Patent Application No. 201811536675.2, filed on Dec. 14, 2018 and entitled "VOLTAGE COMPENSATION METHOD AND APPARATUS, AND DISPLAY DEVICE", the entire contents of which are incorporated herein by reference.

TECHNICAL FIELD

The present disclosure relates to the field of display technologies, and in particular, relates to a voltage compensation method and apparatus, and a display device.

BACKGROUND

An organic light-emitting diode (OLED) display panel includes a plurality of pixel units surrounded by the intersection of a plurality of data lines and a plurality of gate lines. The plurality of pixel units is arranged in an array. Each pixel unit includes a pixel circuit and a luminance control element. The pixel circuit is configured to charge the luminance control element to control the luminance control element to emit light, thereby implementing image display.

In the related art, a pixel circuit generally includes a plurality of transistors. By inputting a drive signal to the pixel circuit, the transistor in the pixel circuit may be controlled to be turned on or turned off, so as to control whether or not to charge the luminance control element.

SUMMARY

The present disclosure provides a voltage compensation method and device, and a display device. The technical solutions are as follows:

In an aspect, a voltage compensation method for a display panel is provided. The display panel includes a plurality of pixel units, wherein at least one of the pixel units includes a pixel circuit and a luminance control element. The method includes:

acquiring an initial parameter value of a charging parameter of a first pixel circuit in a first pixel unit when the display panel is in a non-operating state, wherein the charging parameter indicates a charging capability of the first pixel circuit, the initial parameter value is determined based on a charging voltage of a first luminance control element after loading a driving voltage having an initial loading value to the first pixel circuit to cause the first luminance control element in the first pixel unit to be charged for a target duration, and the first pixel unit is one of the plurality of pixel units;

acquiring a plurality of target parameter values of the charging parameter of the first pixel circuit when the display panel is in an operating state, wherein at least one of the target parameter values is determined based on the charging voltage of the first luminance control element after loading a driving voltage having a drive loading value to the first pixel circuit to cause the first luminance control element in the first pixel unit to be charged for a target duration, and the plurality of target parameter values is determined based on different drive loading values of the driving voltage;

determining a target loading value from a plurality of the drive loading values according to the plurality of target parameter values, wherein a difference between a target parameter value corresponding to the target loading value and the initial parameter value is greater than differences between other target parameter values and the initial parameter value; and adjusting the driving voltage based on the target loading value to compensate for the driving voltage.

Optionally, the first pixel circuit includes a driving transistor for controlling whether to charge the first luminance control element, and the adjusting the driving voltage based on the target loading value to compensate for the driving voltage includes:

determining an amount of change of a threshold voltage of the driving transistor based on the target loading value;

determining a compensation coefficient of a mobility of the driving transistor based on the amount of change; and adjusting the driving voltage loaded to the first pixel circuit based on the amount of change and the compensation coefficient.

Optionally, the amount of change is a difference between the target loading value and the initial loading value.

Optionally, the determining a compensation coefficient of a mobility of the driving transistor based on the amount of change includes:

acquiring, based on a mapping relationship between the threshold voltage and temperature, a target temperature corresponding to the changed threshold voltage according to the amount of change; and acquiring, based on a mapping relationship between the mobility and the temperature, a compensation coefficient of the mobility according to a mobility corresponding to the target temperature.

Optionally, the compensation coefficient K1 of the mobility satisfies: $K1=VS0/[K0\times(VS1+K2)]$;

where K0 is an initial value of the mobility, K2 is the mobility corresponding to the target temperature, VS1 is a charging voltage of the first luminance control element when a driving voltage having a first target value is loaded to the first pixel circuit and the first luminance control element is charged such that the driving transistor in the first pixel circuit is in a cutoff state, VS0 is a second target value used to determine the initial value of the mobility, and the first target value is a sum of the second target value and an initial value of the threshold voltage.

Optionally, an amplitude Vd1 of the adjusted driving voltage satisfies: $Vd1=K0\times K1\times Vd0+V0+V1$;

where V1 is the amount of change, K1 is the compensation coefficient, V0 is an initial value of the threshold voltage, K0 is an initial value of the mobility, and Vd0 is an amplitude of the driving voltage loaded to the first pixel circuit before adjusting the driving voltage.

Optionally, the acquiring an initial parameter value of a charging parameter of a first pixel circuit in a first pixel unit includes:

acquiring a first charging voltage of the first luminance control element after loading a driving voltage having a first initial loading value to the first pixel circuit and charging the first luminance control element for a target duration;

acquiring a second charging voltage of the first luminance control element after loading a driving voltage having a second initial loading value to the first pixel circuit and charging the first luminance control element for the target duration; and determining a ratio of the first charging voltage to the second charging voltage as an initial parameter value of the charging parameter.

Optionally, the acquiring a plurality of target parameter values of the charging parameter of the first pixel circuit includes:

determining a target parameter value based on a set of loading values in a plurality of sets of loading values of the driving voltage, respectively, to obtain the plurality of target parameter values;

wherein each set of loading values includes at least two drive loading values corresponding to at least two initial loading values when determining the initial parameter value, and at least two drive loading values in each set are the same with respect to the adjusted amplitude of the initial loading value.

Optionally, each set of loading values includes a first drive loading value and a second drive loading value; and the determining a target parameter value based on a set of loading values in a plurality of sets of loading values of the drive voltage, respectively, includes:

acquiring a third charging voltage of the first luminance control element after loading a driving voltage having the first drive loading value to the first pixel circuit and charging the first luminance control element for a target duration;

acquiring a fourth charging voltage of the first luminance control element after loading a driving voltage having the second drive loading value to the first pixel circuit and charging the first luminance control element for the target duration; and determining a ratio of the third charging voltage to the fourth charging voltage as a target parameter value corresponding to the first set of loading values.

In another aspect, a voltage compensation apparatus is provided. The apparatus is applied to a display panel. The display panel includes a plurality of pixel units, wherein at least one of the pixel units includes a pixel circuit and a luminance control element. The apparatus includes:

a first acquiring module, configured to acquire an initial parameter value of a charging parameter of a first pixel circuit in a first pixel unit when the display panel is in a non-operating state, wherein the charging parameter indicates a charging capability of the first pixel circuit, the initial parameter value is determined based on a charging voltage of a first luminance control element after loading a driving voltage having an initial loading value to the first pixel circuit to cause the first luminance control element in the first pixel unit to be charged for a target duration, and the first pixel unit is one of the plurality of pixel unit;

wherein the first acquiring module is configured to acquire a plurality of target parameter values of the charging parameter of the first pixel circuit when the display panel is in an operating state, at least one of the target parameter values is determined based on the charging voltage of the first luminance control element after loading a driving voltage having a drive loading value to the first pixel circuit to cause the first luminance control element in the first pixel unit to be charged for a target duration, and the plurality of target parameter values is determined based on different drive loading values;

a determining module, configured to determine a target loading value from a plurality of the drive loading values according to the plurality of target parameter values, wherein a difference between a target parameter value corresponding to the target loading value and the initial parameter value is greater than differences between other target parameter values and the initial parameter value; and an adjusting module, configured to adjust the driving voltage based on the target loading value to compensate for the driving voltage.

Optionally, the first pixel circuit includes a driving transistor for controlling whether to charge the first luminance control element, and the adjusting module includes:

a first determining submodule, configured to determine an amount of change of a threshold voltage of the driving transistor based on the target loading value;

a second determining submodule, configured to determine a compensation coefficient of a mobility of the driving transistor based on the amount of change; and an adjusting submodule, configured to adjust the driving voltage loaded to the first pixel circuit based on the amount of change and the compensation coefficient.

Optionally, the amount of change is a difference between the target loading value and the initial loading value.

Optionally, the second determining submodule is configured to:

acquire, based on a mapping relationship between the threshold voltage and temperature, a target temperature corresponding to the changed threshold voltage according to the amount of change; and acquire, based on a mapping relationship between the mobility and the temperature, a compensation coefficient of the mobility according to a mobility corresponding to the target temperature.

Optionally, an amplitude $Vd1$ of the adjusted driving voltage satisfies: $Vd1=K0\times K1\times Vd0+V0+V1$;

where $V1$ is the amount of change, $K1$ is the compensation coefficient, $V0$ is an initial value of the threshold voltage, $K0$ is an initial value of the mobility, and $Vd0$ is an amplitude of the driving voltage loaded to the first pixel circuit before adjusting the driving voltage.

Optionally, the first acquiring module is configured to:

acquire a first charging voltage of the first luminance control element after loading a driving voltage having a first initial loading value to the first pixel circuit and charging the first luminance control element for a target duration;

acquire a second charging voltage of the first luminance control element after loading a driving voltage having a second initial loading value to the first pixel circuit and charging the first luminance control element for the target duration; and determine a ratio of the first charging voltage to the second charging voltage as an initial parameter value of the charging parameter.

Optionally, the first acquiring module is configured to determine a target parameter value based on a set of loading values in a plurality of sets of loading values of the driving voltage, respectively, to obtain the plurality of target parameter values; wherein each set of loading values includes at least two drive loading values corresponding to at least two initial loading values when determining the initial parameter value, and at least two drive loading values in each set are the same with respect to the adjusted amplitude of the initial loading value.

Optionally, each set of loading values includes a first drive loading value and a second drive loading value, and the first acquiring module is configured to:

acquire a third charging voltage of the first luminance control element after loading a driving voltage having the first drive loading value to the first pixel circuit and charging the first luminance control element for a target duration;

acquire a fourth charging voltage of the first luminance control element after loading a driving voltage having the second drive loading value to the first pixel circuit and charging the first luminance control element for the target duration; and determine a ratio of the third charging voltage to the fourth charging voltage as a target parameter value corresponding to a set of loading values.

In still another aspect, a display device is provided. The display device includes a display panel and a voltage compensation apparatus according to any of the above aspects. The display panel includes a plurality of pixel units arranged in an array, wherein at least one of the pixel unit includes a pixel circuit and a luminance control element.

The voltage compensation apparatus is configured to compensate for a driving voltage of the pixel circuit in the pixel unit by adjusting a driving voltage loaded to the pixel circuit based on a charging parameter of the pixel circuit.

In yet still another aspect, a device for use in voltage compensation is provided. The device includes a processor and a memory.

The device performs the voltage compensation method according to any of the above aspects when the processor executes a computer program stored in the memory.

In a yet still another aspect, a non-transitory computer-readable storage medium is provided. The storage medium stores a computer program, wherein the computer program instructs a voltage compensation apparatus to perform the voltage compensation method according to any of the above aspects.

BRIEF DESCRIPTION OF THE DRAWINGS

For clearer description of the technical solutions according to the embodiments of the present disclosure, the following briefly introduces the accompanying drawings required for describing the embodiments. Apparently, the accompanying drawings in the following description show merely some embodiments of the present disclosure, and a person of ordinary skill in the art may also derive other drawings from these accompanying drawings without creative efforts.

DETAILED DESCRIPTION

Figure 1:
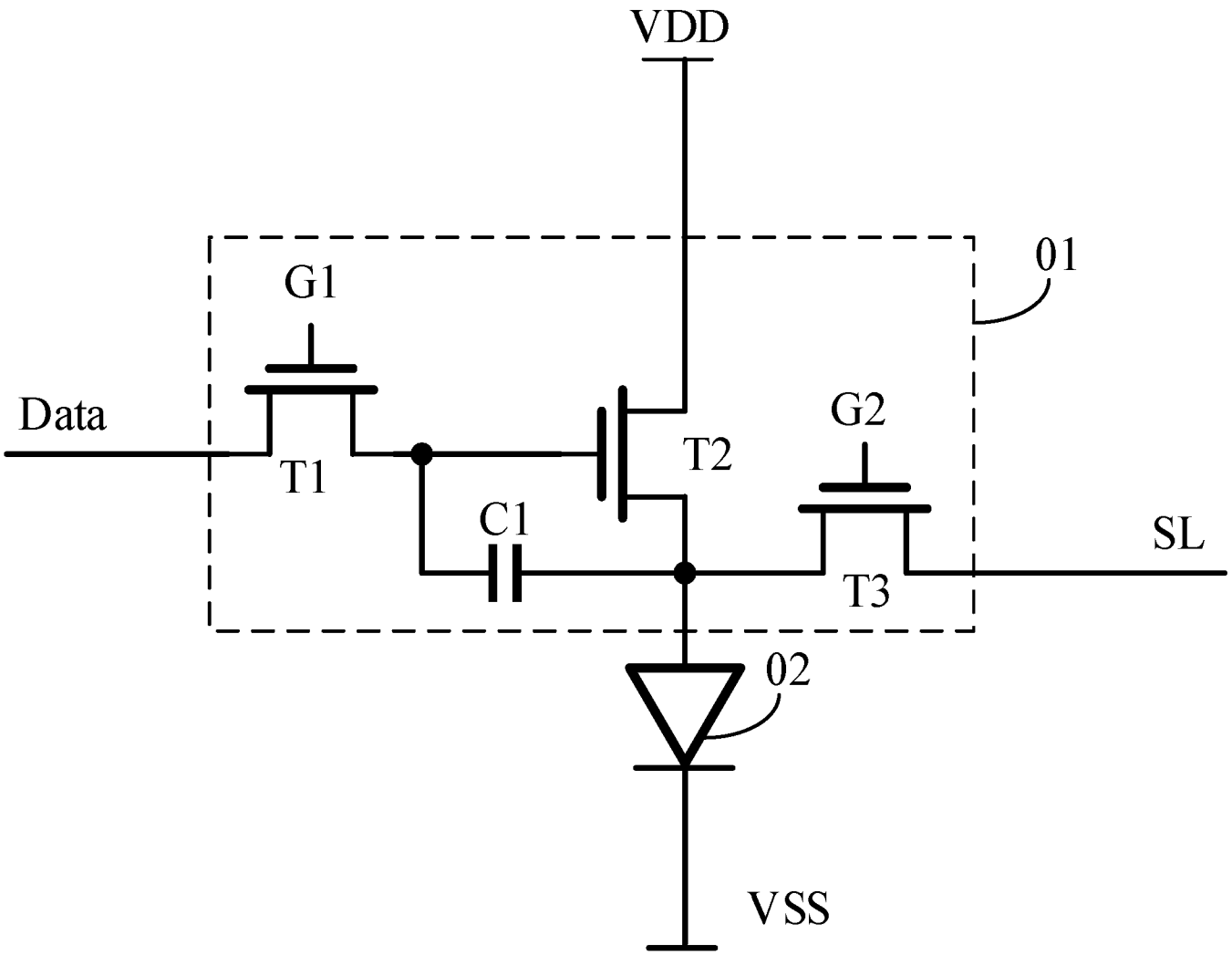
FIG. 1 is a schematic structural diagram of a pixel unit according to an embodiment of the present disclosure.

The present disclosure is hereinafter described in further detail with reference to the accompanying drawings, to present the objects, technical solutions, and advantages of the present disclosure more clearly.

During the display process of the display panel, the electrical characteristics of the transistor may be affected by the temperature, which causes the charging capability of the pixel circuit to be affected, thereby causing a lower charging efficiency when the luminance control element is charged through the pixel circuit.

An embodiment of the present disclosure provides a display device. The display device may include a voltage compensation apparatus and a display panel. The display panel may include a plurality of pixel units arranged in an array. At least one of the pixel units may include a pixel circuit and a luminance control element. For example, each pixel unit may include a pixel circuit and a luminance control element. The pixel circuit in the pixel unit is configured to charge the luminance control element in the pixel unit.

Optionally, the display panel may be any component having a display function such as a liquid crystal panel, an electronic paper, an organic light-emitting diode (OLED) panel, an active matrix organic light-emitting diode (AMOLED) display panel, a mobile phone, a tablet computer, a television, a display, a laptop computer, a digital photo frame or a navigator.

Optionally, when the display panel is an OLED panel, the luminance control element may also be referred to as a light-emitting element. The luminance control element may include an OLED. The OLED may include an anode, a light-emitting layer, and a cathode. When the display panel is a liquid crystal panel, the luminance control element may include a pixel electrode, a liquid crystal, and a common electrode.

Optionally, at least one of the pixel circuits may include a driving transistor. For example, each of the pixel circuits may include a driving transistor. The driving transistor is configured to control whether to charge the luminance control element in the pixel unit wherein the driving transistor is disposed.

The voltage compensation device is configured to adjust a driving voltage loaded to a first pixel circuit in a first pixel unit when charging a first luminance control element in the first pixel unit based on a charging parameter of the first pixel circuit and based on mapping relationships of a threshold voltage and a mobility as a function of temperature (i.e., a mapping relationship between the threshold voltage and temperature, and a mapping relationship between the mobility and temperature), to compensate for the driving voltage of the first pixel circuit.

The charging parameter indicates a charging capability of the first pixel circuit. The charging parameter may be determined based on a charging voltage of the first luminance control element in the first pixel unit after the first pixel circuit is loaded with a driving voltage and charged for a target duration when the first luminance control element is charged. The first pixel unit may one of the plurality of pixel units.

For example, FIG. 1 is a schematic structural diagram of a pixel unit according to an embodiment of the present disclosure. Using a pixel unit in an OLED panel as an example, as illustrated in FIG. 1, the pixel unit may include a pixel circuit 01 and a luminance control element 02 connected to the pixel circuit 01. The pixel circuit 01 may include a switching transistor T1, a driving transistor T2, an auxiliary transistor T3, and a capacitor C1.

A gate of the switching transistor T1 is connected to a first control signal terminal G1; a first electrode of the switching transistor T1 is connected to a data signal line Data, wherein the data signal line Data is loaded with a data signal which is a drive signal supplied to the pixel unit; a second electrode of the switching transistor T1 is connected to a gate of the driving transistor T2; a first electrode of the driving transistor T2 is connected to a first power terminal VDD; a second electrode of the driving transistor T2 is connected to one end of the luminance control element 02; and the other end of the light-emitting unit 02 is connected to a second power terminal VSS. At this time, a charging voltage of the luminance control element 02 is a voltage of the second electrode of the driving transistor T2. A gate of the auxiliary transistor T3 is connected to a second control signal terminal G2; a first electrode of the auxiliary transistor T3 is connected to the second electrode of the driving transistor T2; a second electrode of the auxiliary transistor T3 is connected to a sensing line SL which may selectively be suspended or grounded as needed; one end of the capacitor C1 is connected to the second electrode of the switching transistor T1; and the other end of the capacitor C1 is connected to the luminance control element 02.

In an embodiment of the present disclosure, the first and second electrodes of the transistor may each be either a source or a drain. For example, the first electrode may be a drain, and the second electrode may be a source.

Figure 2:
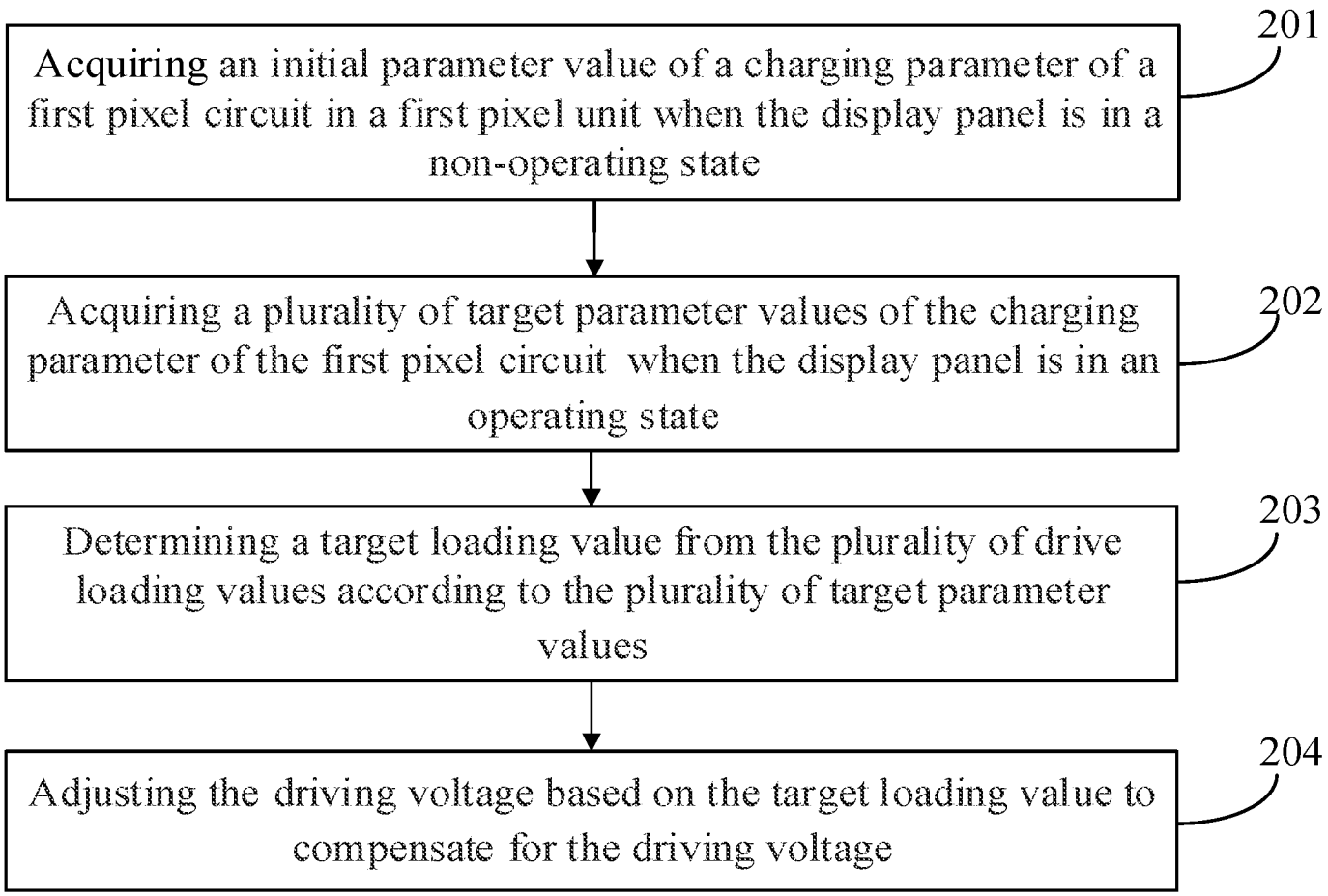
FIG. 2 is a flowchart of a voltage compensation method according to an embodiment of the present disclosure.

An embodiment of the present disclosure provides a voltage compensation method. The method may be applied to a display panel according to the above embodiments. As illustrated in FIG. 2, the method may include the following steps.

In step 201, an initial parameter value of a charging parameter of a first pixel circuit in a first pixel unit is acquired when the display panel is in a non-operating state.

The initial parameter value is determined based on a charging voltage of a first luminance control element after loading a driving voltage having an initial loading value to the first pixel circuit to cause the first luminance control element in the first pixel unit to be charged for a target duration In step 202, a plurality of target parameter values of the charging parameter of the first pixel circuit is acquired when the display panel is in an operating state.

The plurality of target parameter values is determined according to a plurality of different drive loading values of the driving voltage. At least one of the plurality of target parameter values is determined based on a charging voltage of the first luminance control element in the first pixel unit after loading a driving voltage having a drive loading value to the first pixel circuit to cause the first luminance control element in the first pixel unit to be charged for a target duration when the first luminance control element is charged. For example, each target parameter value may be determined by the above method.

Figure 5:
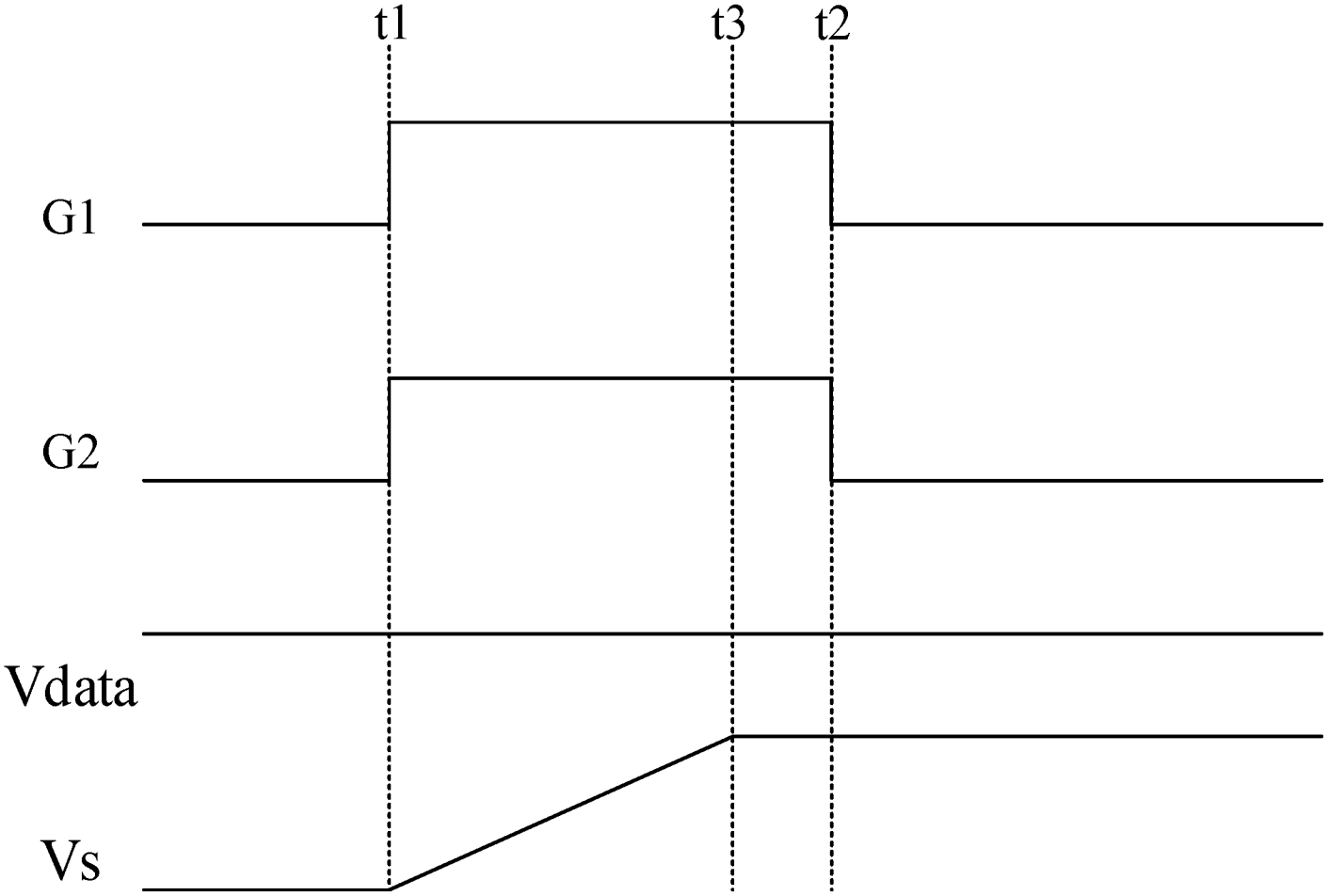
FIG. 5 is a time sequence diagram of charging a luminance control element in a first pixel unit by a driving transistor according to an embodiment of the present disclosure.

In the embodiment of the present disclosure, the operating state of the display panel may refer to a state in which the display panel normally displays an image, and the non-operating state of the display panel may refer to black screen state in which the display panel fails to display anything. For example, for a liquid crystal panel, the display panel may be placed in the non-operating state by turning off a backlight. For an OLED panel, the display panel may be placed in the non-operating state by controlling the display panel to display a black screen or controlling a pixel circuit to operate in accordance with, for example, a sensing time sequence as illustrated in FIG. 5.

In step 203, a target loading value is determined from the plurality of drive loading values according to the plurality of target parameter values.

The target parameter value corresponding to the target loading value is a target parameter value closest to the initial parameter value among the plurality of target parameter values a direction in which the plurality of target parameter values converge toward the initial parameter value. That is, a difference between a target parameter value corresponding to the target loading value and the initial parameter value is greater than differences between other target parameter values and the initial parameter value.

In step 204, the driving voltage is adjusted based on the target loading value to compensate for the driving voltage.

In the embodiment of the present disclosure, an amount of change of a threshold voltage of the driving transistor in the first pixel circuit and an amount of change of a mobility of the driving transistor may be determined based on the target loading value, and then the driving voltage may be adjusted based on the determined amount of change to compensate for the driving voltage.

In summary, in the voltage compensation method according to the embodiment of the present disclosure, an initial parameter value and a plurality of target parameter values of a charging parameter of a pixel circuit is acquired respectively when the display panel is in a non-operating state and an operating state, a target loading value is determined according to the plurality of target parameter values, and then a driving voltage is adjusted according to the target loading value to compensate for the driving voltage. Since the target loading value is a loading value corresponding to the target parameter value closest to the initial parameter value among the plurality of target parameter values, and the charging parameter indicates a charging capability of the first pixel circuit, it may be determined that when the target loading value is provided to the pixel circuit, the charging capability of the pixel circuit is closest to the charging capability when the display panel is in an non-operating state. Compared with the related art, by adjusting the driving voltage of the pixel circuit according to the target loading value, the driving voltage may be compensated according to the actual charging capability of the pixel circuit, which may ensure the charging capability of the pixel circuit and ensure the charging efficiency of the pixel control circuit for the luminance control element.

Figure 3:
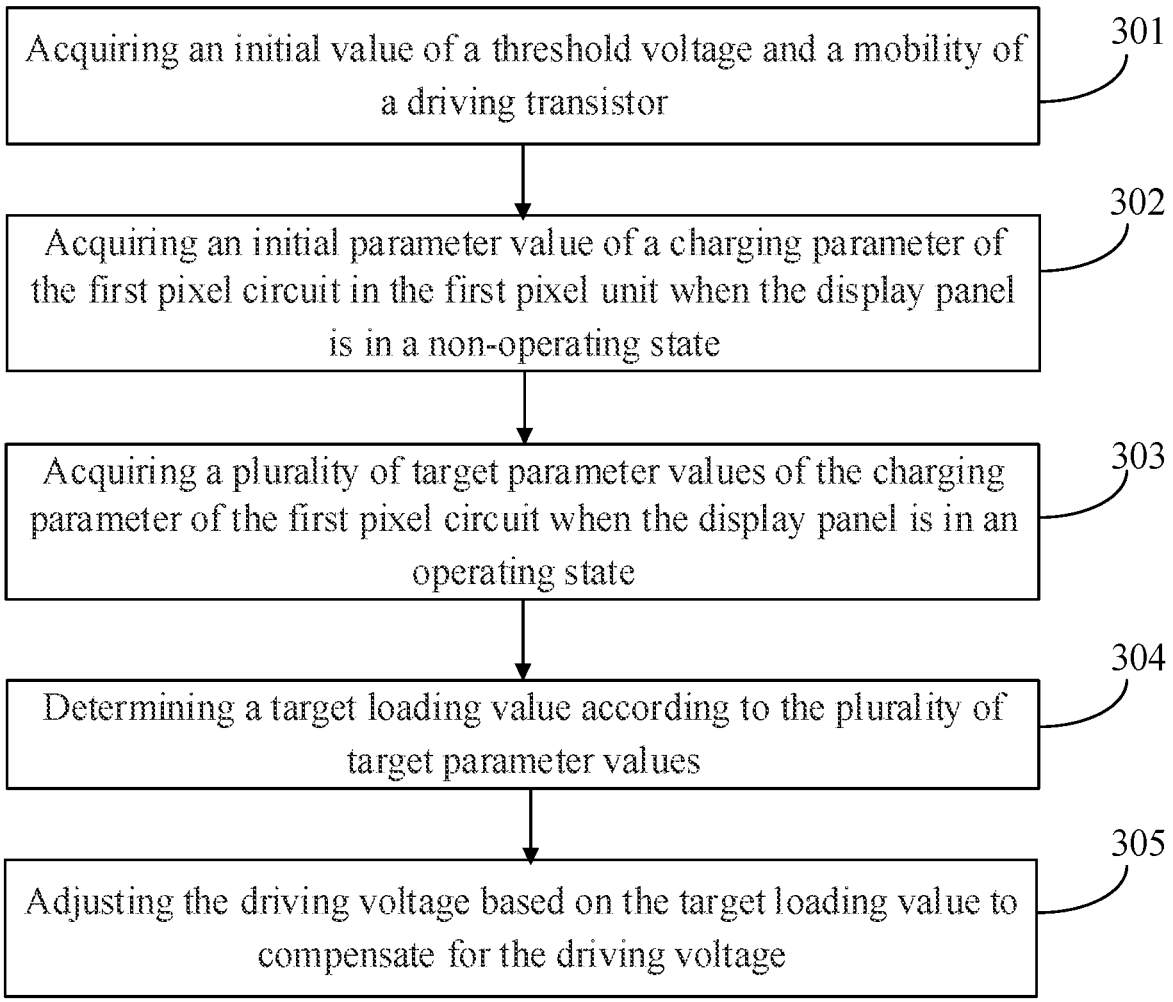
FIG. 3 is a flowchart of another voltage compensation method according to an embodiment of the present disclosure.

FIG. 3 is a flowchart of another voltage compensation method according to an embodiment of the present disclosure. The method is applicable to a display device according to an embodiment of the present disclosure. As illustrated in FIG. 3, the method may include the following steps.

In step 301, an initial value of a threshold voltage and a mobility of a driving transistor are acquired.

The threshold voltage of the driving transistor may be the minimum voltage difference between a gate voltage and a source voltage required when the driving transistor forms a conductive channel (i.e., the driving transistor is turned on). The threshold voltage may also be referred to as an ON voltage. The source voltage may also be referred to as an output voltage of the driving transistor. Since the change in electrical characteristics (also called characteristic drift) of a transistor in a short time is usually caused by temperature, the characteristic drift of the transistor in a short time is mainly caused by changes in the threshold voltage and mobility of the transistor under the influence of temperature, and the change in the electrical characteristics of the transistor is a major factor affecting the charging capability of the pixel circuit, the driving voltage input to the pixel circuit may be compensated according to the threshold voltage and mobility of the transistor.

Figure 4:
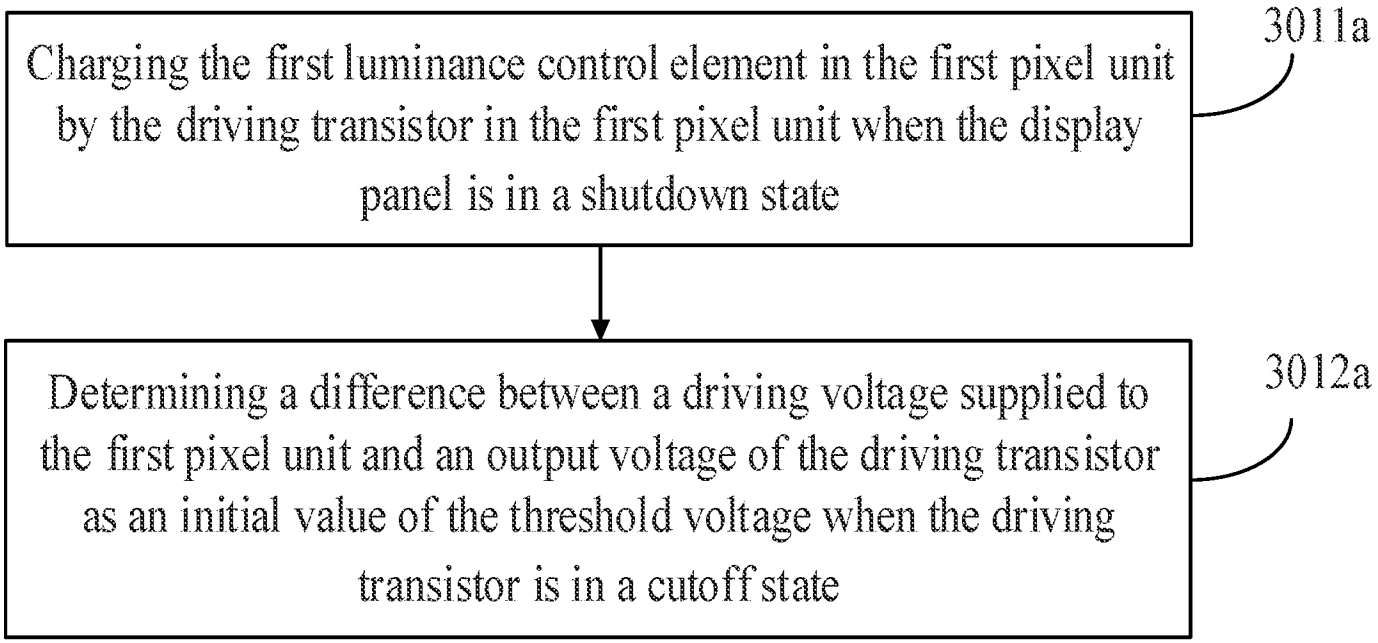
FIG. 4 is a flowchart of a method for acquiring an initial value of a threshold voltage of a driving transistor according to an embodiment of the present disclosure.

In an implementation, as illustrated in FIG. 4, the implementation process of acquiring an initial value of a threshold voltage of a driving transistor may include the following steps.

In step 3011*a*, when the display panel is in a shutdown state, the first luminance control element in the first pixel unit is charged by the driving transistor in the first pixel unit.

The shutdown state may refer to a non-operating state.

In step 3012*a*, when the driving transistor is in a cutoff state, a difference between a driving voltage supplied to the first pixel unit and an output voltage of the driving transistor is determined as an initial value of the threshold voltage.

When the driving transistor is in a cutoff state, an output current of the driving transistor is small. At this time, a voltage difference between the gate voltage VG and the source voltage Vs of the driving transistor may be determined as the threshold voltage Vth of the driving transistor, that is, Vth=VG−Vs.

The source voltage Vs of the driving transistor is the voltage of the second electrode of the driving transistor, that is, the output voltage of the driving transistor. As may be seen from FIG. 1, the source of the driving transistor is connected to one end of the luminance control element, so that the source voltage Vs is also the charging voltage of the luminance control element.

Since the threshold voltage is detected when the display panel is in a shutdown state, the temperature of the display panel hardly changes during the process. That is, the threshold voltage is hardly affected by the temperature of the display panel. Therefore, this voltage difference is determined as the initial value of the threshold voltage.

For example, continuing to refer to FIG. 1, in the pixel circuit shown in FIG. 1, the gate voltage of the driving transistor T2 is equal to the output voltage of the switching transistor T1. Since the gate voltage loaded on the gate of the switching transistor T1 is typically much larger than the input voltage loaded to the signal input (i.e., the first electrode) of the switching transistor T1, the output voltage of the switching transistor T1 may be regarded as being equal to the input voltage input to the switching transistor T1. That is, the initial value of the threshold voltage of the driving transistor T2 may be a voltage difference between an input voltage input to the switching transistor T1 and an output voltage of the driving transistor T2.

When a data signal is loaded on the signal input terminal of the switching transistor the threshold voltage of the driving transistor T2 is the voltage difference between the voltage amplitude of the data signal and the output voltage of the driving transistor T2. Correspondingly, the initial value of the threshold voltage of the driving transistor T2 may be determined as the voltage difference between the voltage amplitude of the data signal and the output voltage of the driving transistor T2 when the driving transistor T2 is in a cutoff state.

FIG. 5 is a time sequence diagram of charging a first luminance control element by a driving transistor. Referring to FIG. 5, the period t1 to t2 is a period of charging the first luminance control element, and Vs represents an output voltage of the driving transistor. According to the time sequence chart, it may be seen that the driving transistor is in a cutoff state during the period from t3 to t2, and the initial value of the threshold voltage of the driving transistor may be acquired as the voltage difference between the voltage amplitude Vdata of the data signal input to the switching transistor and the output voltage Vs of the driving transistor during the period from t3 to t2.

For example, assuming that the voltage amplitude Vdata of the data signal is 5 volts (V) and the output voltage Vs of the driving transistor is 4.8V during the charging process, the initial value of the threshold voltage of the driving transistor may be determined as V0=Vdata−Vs=5 V−4.8 V=0.2 V.

Figure 6:
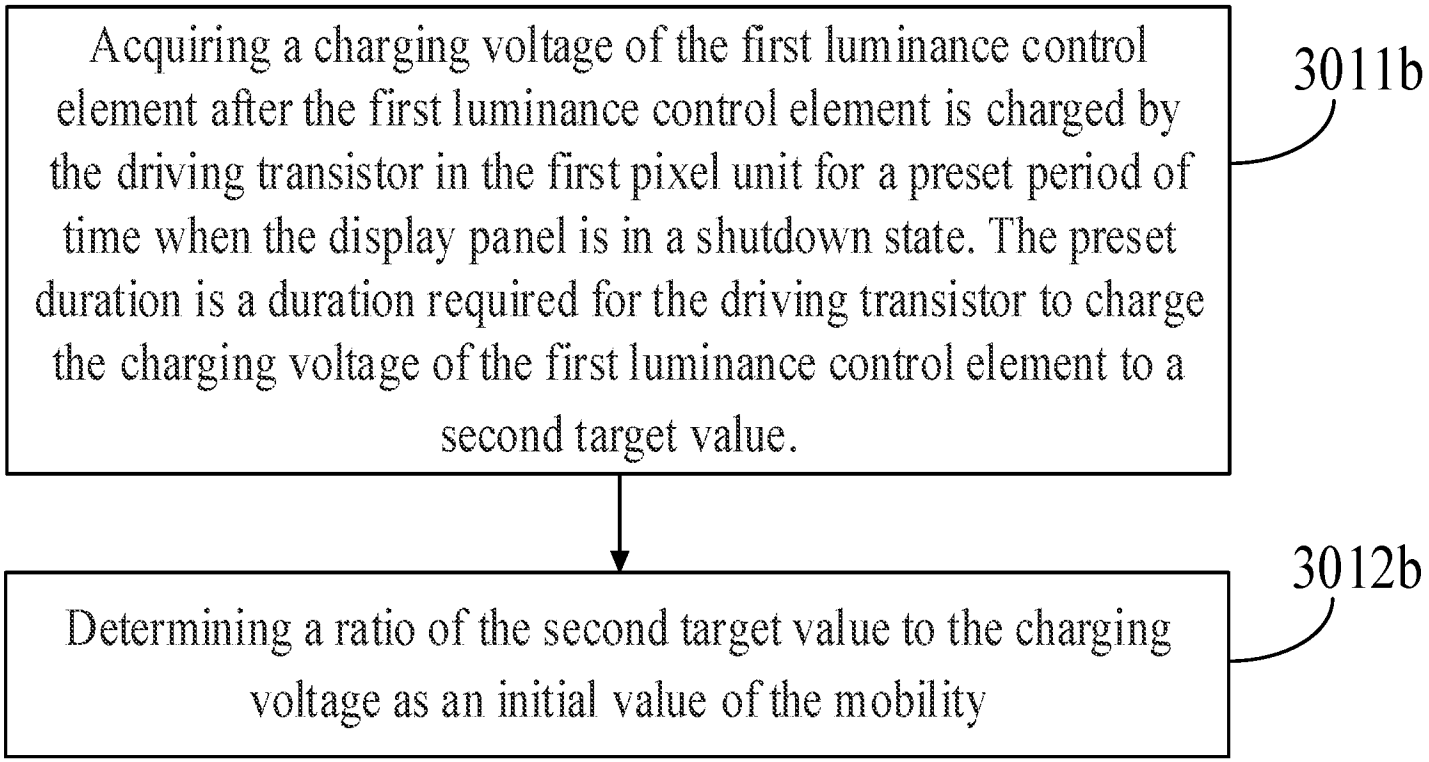
FIG. 6 is a flowchart of a method for acquiring an initial value of a mobility of a driving transistor according to an embodiment of the present disclosure.

In an implementation, as illustrated in FIG. 6, the implementation process of acquiring an initial value of a mobility of the driving transistor may include the following steps.

In step 3011*b*, when the display panel is in a shutdown state, a charging voltage of the first luminance control element after the first luminance control element is charged by the driving transistor in the first pixel unit for a preset period of time is acquired. The preset duration is a duration required for the driving transistor to charge the charging voltage of the first luminance control element to a second target value.

The preset duration may be determined according to a driving voltage having a first target value loaded to the first pixel circuit. For example, the first target value may be determined based on a range of approximate values of the mobility of the driving transistor, A theoretical duration required to charge the charging voltage of the first luminance control element to the second target value by the driving transistor is then determined, and the required theoretical duration is determined as the predetermined duration. Then, the charging voltage of the first luminance control element is acquired after a driving voltage having the first target value is loaded to the first pixel circuit and the first luminance control element is charged for a preset period of time. The first target value may be a sum of the second target value and the initial value of the threshold voltage.

In step 3012*b*, a ratio of the second target value to the charging voltage is determined as an initial value of the mobility.

Figure 7:
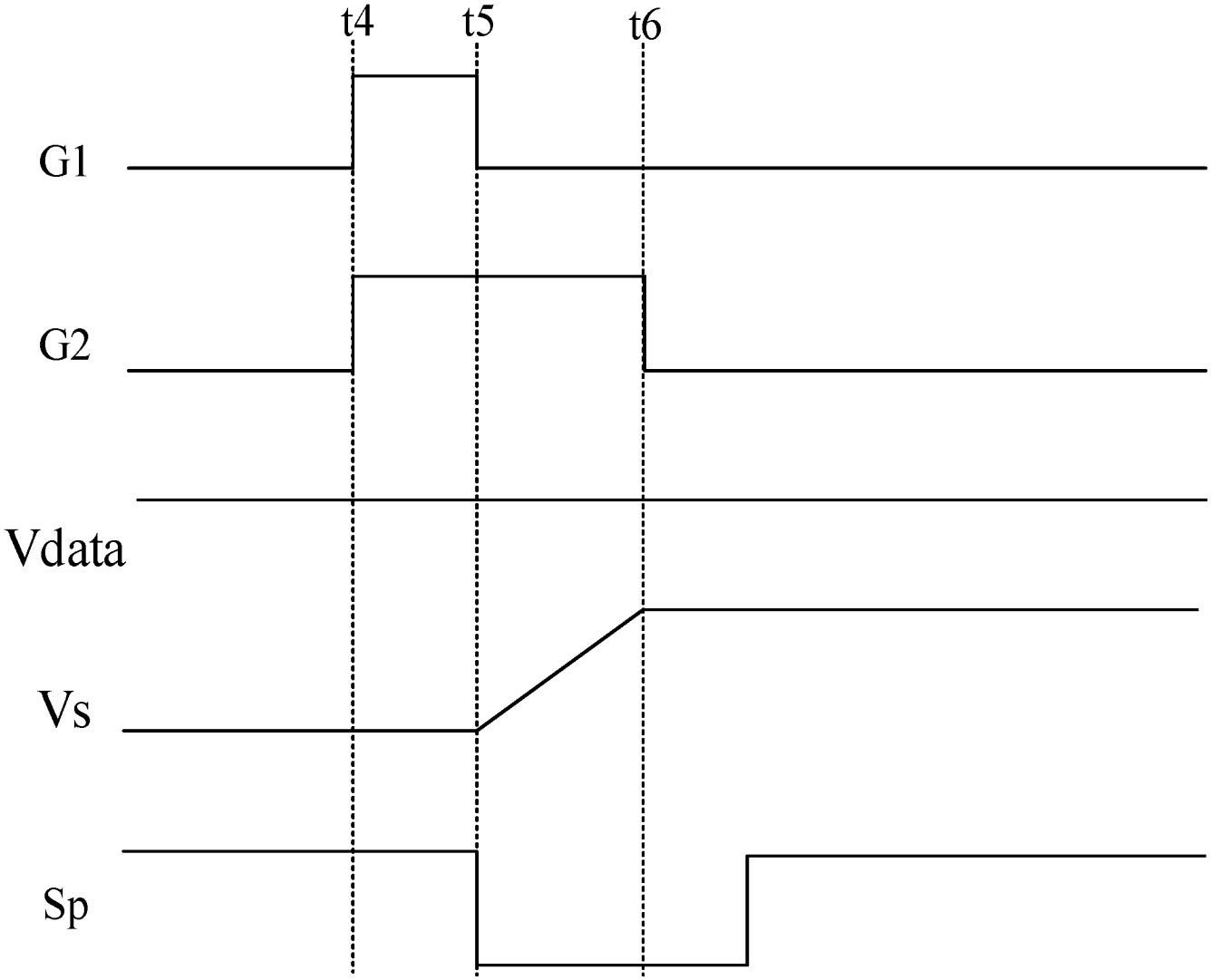
FIG. 7 is a time sequence diagram of another method for charging a luminance control element in a first pixel unit by a driving transistor according to an embodiment of the present disclosure.

FIG. 7 is a time sequence diagram of charging a first luminance control element by a driving transistor in a first pixel unit. As illustrated in FIG. 7, during the charging process, the first control signal at the high potential may be provided through the first control signal terminal G1 during the period from t4 to t5, and the second control signal at the high potential may be provided through the second control signal terminal G2 during the period from t4 to t6 such that the first luminance control element may be charged by the driving transistor during the period from t4 to t6. The duration |t6−t4| may be determined according to the second target value VS0. Then, after the driving transistor charges the first luminance control element for a duration |t6−t4|, the charging voltage Vs of the first luminance control element at time t6 is VS1.

Since the charging process is performed when the display panel is in a shutdown state, the temperature of the display panel hardly changes during the charging process. That is, the charging voltage is hardly affected by the temperature of the display panel. Therefore, the ratio of the second target value VS0 to the charging voltage VS1 is determined as the initial value of the mobility. Here, in FIG. 7, when the control voltage sp is high, it means that the sensing line is grounded. When the control voltage sp is low, it indicates that the sensing line is floating. At this time, it may be considered that the sensing line is connected to the capacitor.

Illustratively, in the charging process, assuming that the second target value VS0=1.8 V, the preset duration determined according to the second target value is t. After the first luminance control element is charged for the duration t through the driving transistor in the first pixel unit, the charging voltage of the first luminance control element is VS1=1.5 V. At this time, it is possible to determine the initial value of the mobility K0=VS0/VS1=1.8 V/1.5 V=1.2.

In step 302, an initial parameter value of a charging parameter of the first pixel circuit in the first pixel unit is acquired when the display panel is in a non-operating state.

The charging parameter indicates the charging capability of the first pixel circuit. The charging parameter may be determined based on the charging voltage of the first luminance control element after the first pixel circuit is loaded with a driving voltage and charged for a target duration when the first luminance control element is charged. Optionally, the initial parameter value of the charging parameter may be determined according to at least two initial loading values of the driving voltage.

Figure 8:
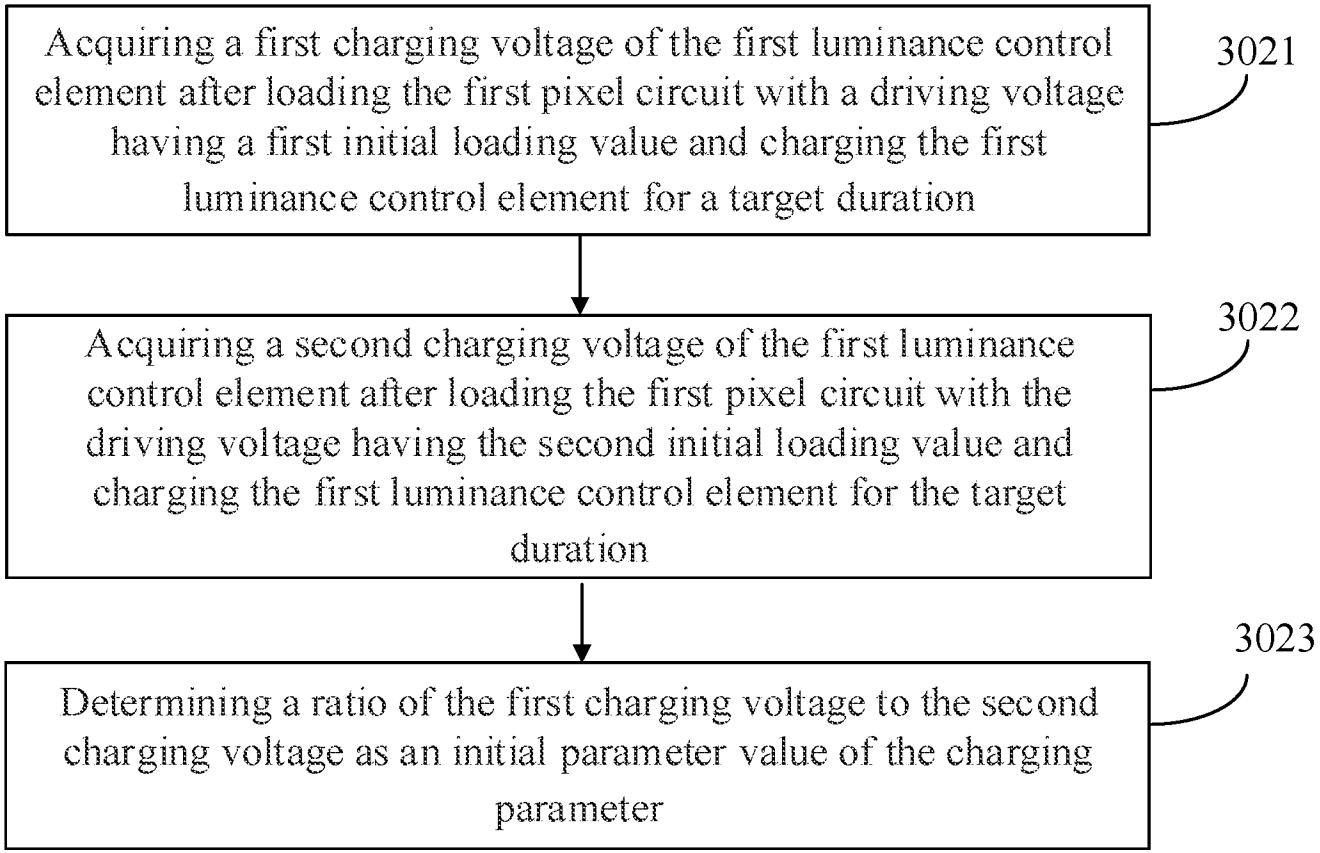
FIG. 8 is a flowchart of a method for acquiring an initial parameter value of a charging parameter of a first pixel circuit in a first pixel unit according to an embodiment of the present disclosure.

For example, as illustrated in FIG. 8, when the initial parameter value of the charging parameter is determined according to two initial loading values of the driving voltage, the implementation process of step 302 may include the following steps.

In step 3021, a first charging voltage of the first luminance control element after loading the first pixel circuit with a driving voltage having a first initial loading value and charging the first luminance control element for a target duration is acquired.

The target duration may be determined according to actual needs. For example, the target duration may be a duration that causes the driving transistor to reach a cutoff state. Optionally, the target duration may be a shorter duration. For example, the target duration may be determined as 20 microseconds. Moreover, when the target duration is short, on the one hand, the detection time for detecting the charging capability of the first pixel circuit may be shortened, and on the other hand, the probability that other signals affect the charging process may be reduced to minimize the impact on the charging process by the other signals.

Figure 9:
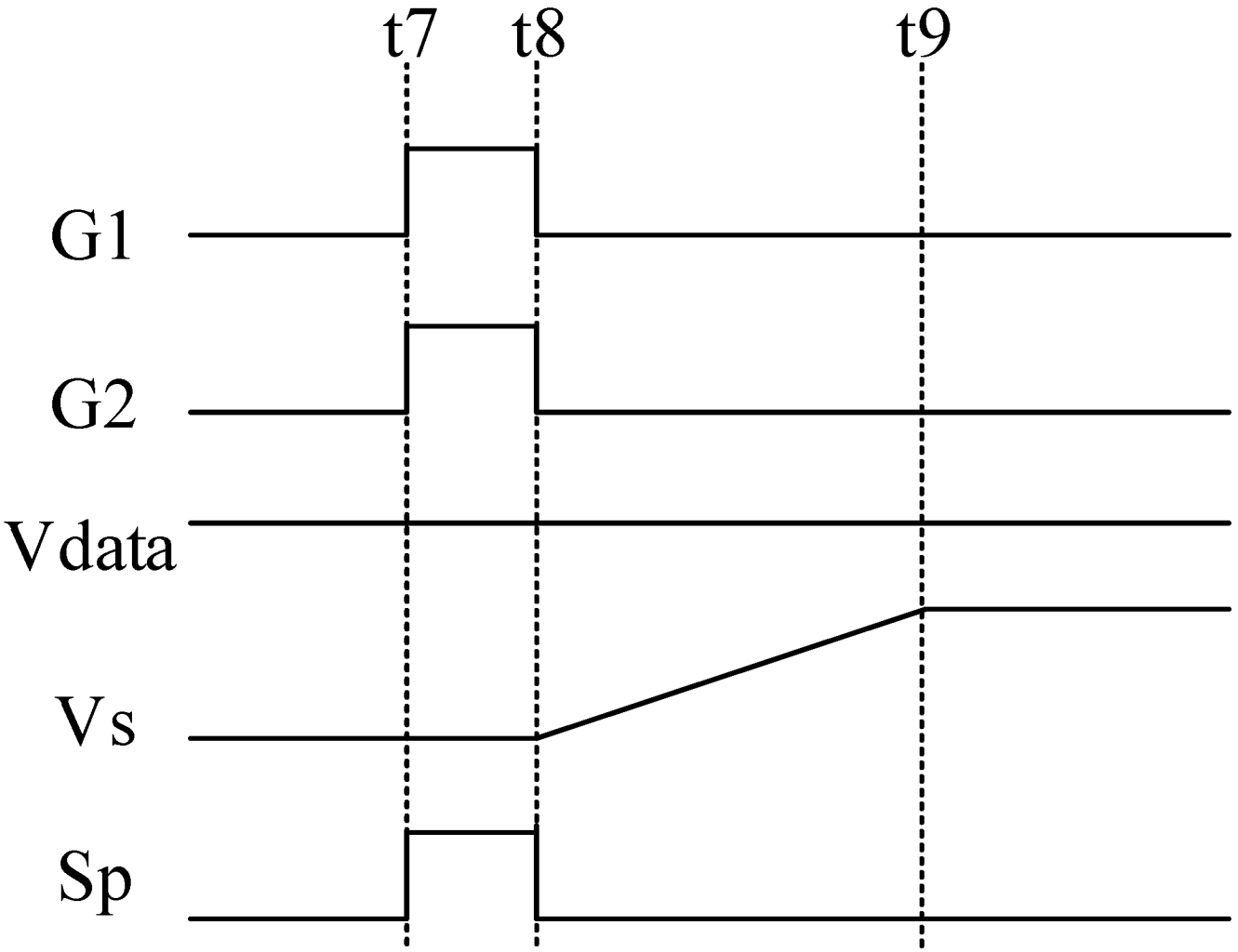
FIG. 9 is a time sequence diagram of still another method for charging a luminance control element in a first pixel unit by a driving transistor according to an embodiment of the present disclosure.

For example, referring to FIG. 9, the first control signal terminal G1 may be controlled to provide a first control signal at a high potential for a period of time t7 to t8 to bring the switching transistor T1 into an ON state. At this time, the voltage of the voltage amplitude value Vdata supplied from the data signal line may be input to the driving transistor T2 through the switching transistor T1 to write a drive signal for charging the first luminance control element to the driving transistor T2. The second control signal terminal G2 is controlled to provide the second control signal at the high potential to the auxiliary transistor T3 during the period from t7 to t8, so that the auxiliary transistor T3 is in a turn-on state.

At this time, the control voltage Sp is at a high potential during the period from t7 to t8, so that the sensing line is grounded, and the grounded sensing line may maintain the first charging voltage of the first luminance control element to be zero through the auxiliary transistor T3 resetting the first charging voltage of the first luminance control element to ensure the accuracy of the first charging voltage acquired after charging the first luminance control element.

After the reset of the first charging voltage is completed, the control voltage Sp is at a low potential for a period from t8 to t9. At this time, the first luminance control element may be charged according to the written drive signal by the driving transistor T2. After being charged to the time t9 (i.e., the target duration reaches the time length |t9−t8|), the driving transistor T2 is controlled to stop charging the first luminance control element and acquire the first charging voltage of the first luminance control element at that moment.

In step 3022, a second charging voltage of the first luminance control element after loading the first pixel circuit with the driving voltage having the second initial loading value and charging the first luminance control element for the target duration is acquired.

The implementation process of step 3022 may be made reference to the implementation process of step 3021.

In step 3023, a ratio of the first charging voltage to the second charging voltage is determined as an initial parameter value of the charging parameter.

When determining an initial parameter value of the charging parameter according to two initial loading values of the driving voltage, the initial parameter value may be a ratio of a first charging voltage determined according to the first initial loading value and a second charging voltage determined according to the second initial loading value.

Moreover, since the charging parameter indicates the charging capability of the first pixel circuit, and the initial parameter value is a ratio of the first charging voltage to the second charging voltage, in order to ensure the accuracy of the initial parameter value, it is required to ensure that the first charging voltage and the second charging voltage are charging voltages acquired when the first pixel circuits have the same or approximately the same state of charge. In an implementation, the above may be achieved by setting the target duration for charging in step 3022 to be equal to the target duration for charging in step 3021. For example, the target duration for charging in step 3022 and the target duration for charging in step 3021 may each be 20 microseconds.

In step 303, a plurality of target parameter values of the charging parameter of the first pixel circuit is acquired when the display panel is in an operating state.

At least one of the plurality of target parameter values may be determined based on the charging voltage of the first control element after loading a driving voltage with a drive loading value to the first pixel circuit and causing the first luminance control element to be charged for a target duration. For example, each target parameter value may be determined based on the aforementioned method. The plurality of target parameter values may be determined according to a plurality of different drive loading values of the driving voltage.

Optionally, different drive loading values of the driving voltage may be divided into a plurality of sets of loading values. When determining the target parameter values, one target parameter value may be determined based on each set of loading values of the driving voltage, respectively, to obtain a plurality of target parameter values.

Moreover, each set of loading values may include at least two drive loading values corresponding to at least two initial loading values when determining the initial parameter value, and at least two drive loading values in each set are the same with respect to the adjustment amplitude of the corresponding initial loading values.

Exemplarily, when the initial parameter value of the charging parameter is determined according to two initial loading values of the driving voltage, the two initial loading values may be the first initial loading value and the second initial loading value. Correspondingly, when determining the target parameter value, each set of loading values may include a first drive loading value and a second drive loading value. The first drive loading value corresponds to the first initial loading value. The second drive loading value corresponds to the second initial loading value. The adjustment amplitude of the first drive loading value with respect to the first initial loading value is the same as the adjustment amplitude of the second drive loading value with respect to the second initial loading value.

For example, the first initial loading value may be V11, the second initial loading value may be V12, the first drive loading value may be V11+Δ1, and the second drive loading value may be V12+Δ1. The adjustment amplitudes of the first drive loading value and the second drive loading value with respect to the corresponding initial loading value are both Δ1.

Figure 10:
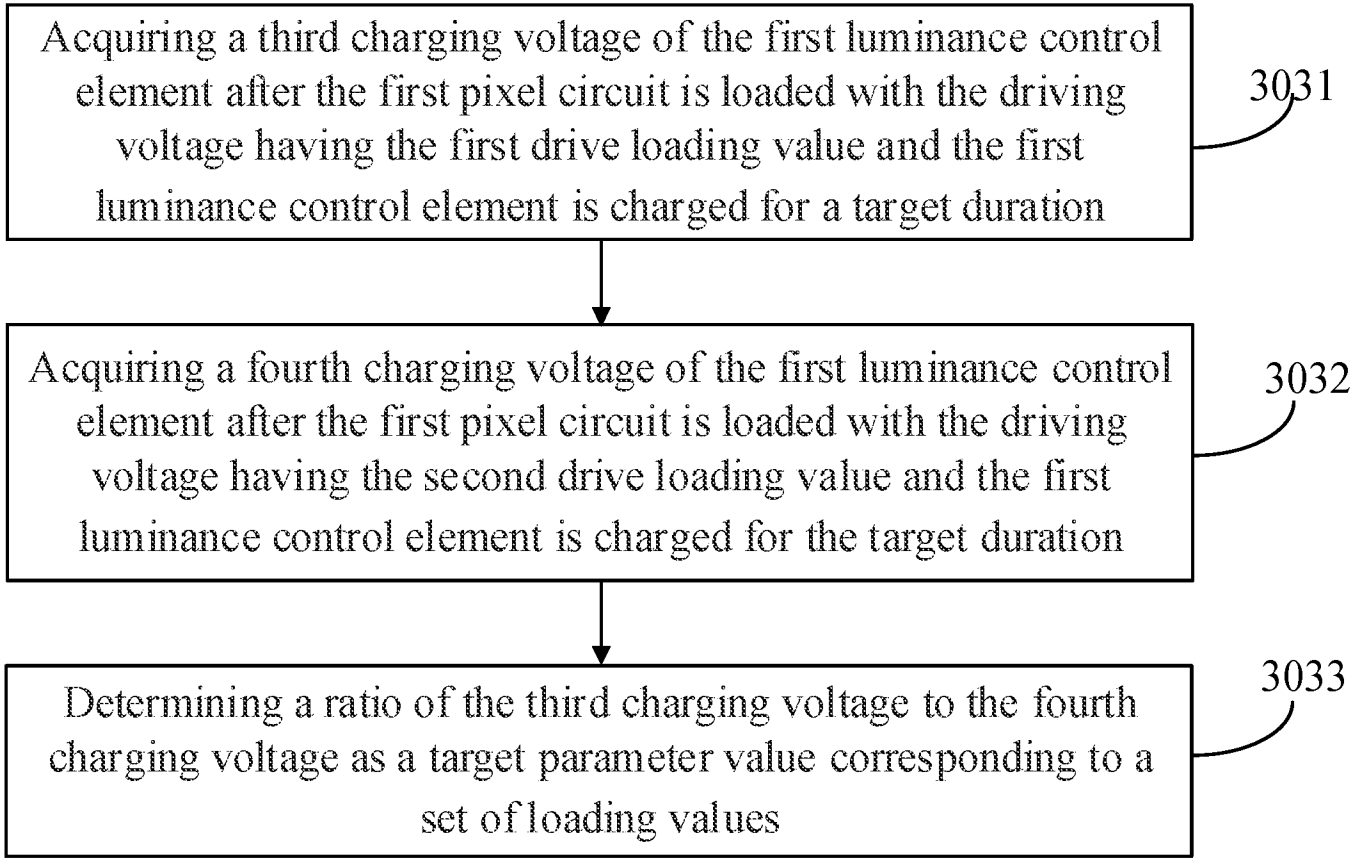
FIG. 10 is a flowchart of a method for determining a target parameter value based on each set of loading values according to an embodiment of the present disclosure.

As illustrated in FIG. 10, when each set of loading values includes a first drive loading value and a second drive loading value, an implementation process of determining a target parameter value according to one of the plurality of sets of loading values may include the following steps.

In step 3031, a third charging voltage of the first luminance control element after the first pixel circuit is loaded with the driving voltage having the first drive loading value and the first luminance control element is charged for a target duration is acquired.

In step 3032, a fourth charging voltage of the first luminance control element after the first pixel circuit is loaded with the driving voltage having the second drive loading value and the first luminance control element is charged for the target duration is acquired.

In step 3033, a ratio of the third charging voltage to the fourth charging voltage is determined as a target parameter value corresponding to a set of loading values.

The implementation process of step 3031 to step 3033 may refer to the implementation process of step 3021 to step 3023.

Moreover, since step 3031 to step 3033 are performed in the process that the display panel is in an operating state, in order to ensure that the implementation process of step 303 does not affect the display effect of the display panel, the process of charging the first luminance control element in step 303 may be performed in a non-display area (also referred to as a blanking area) of the display panel, and/or the process of charging the first luminance control element in step 303 may be performed in a blanking time of the image display to avoid the influence of the normal display of the display panel and ensure the display effect of the display panel.

In step 304, a target loading value is determined according to the plurality of target parameter values.

The target parameter value corresponding to the target loading value is a target parameter value closest to the initial parameter value among the plurality of target parameter values a direction in which the plurality of target parameter values converge toward the initial parameter value. That is, a difference between a target parameter value corresponding to the target loading value and the initial parameter value is greater than differences between other target parameter values and the initial parameter value Since both the initial parameter value and the target parameter value are charging parameters that indicate the charging capability of the first pixel circuit when the corresponding driving voltage is loaded to the first pixel circuit, when the target parameter value and the initial parameter are closer, the charging capability exhibited by the first pixel circuit by loading the corresponding driving voltage to the first pixel circuit is closer to the charging capability of the first pixel circuit when the initial parameters are acquired. Therefore, the loading value corresponding to the target parameter value closest to the initial parameter value among the plurality of target parameter values may be determined as the target loading value, and the driving voltage is compensated according to the target loading value.

In step 305, the driving voltage is adjusted based on the target loading value to compensate for the driving voltage.

Figure 11:
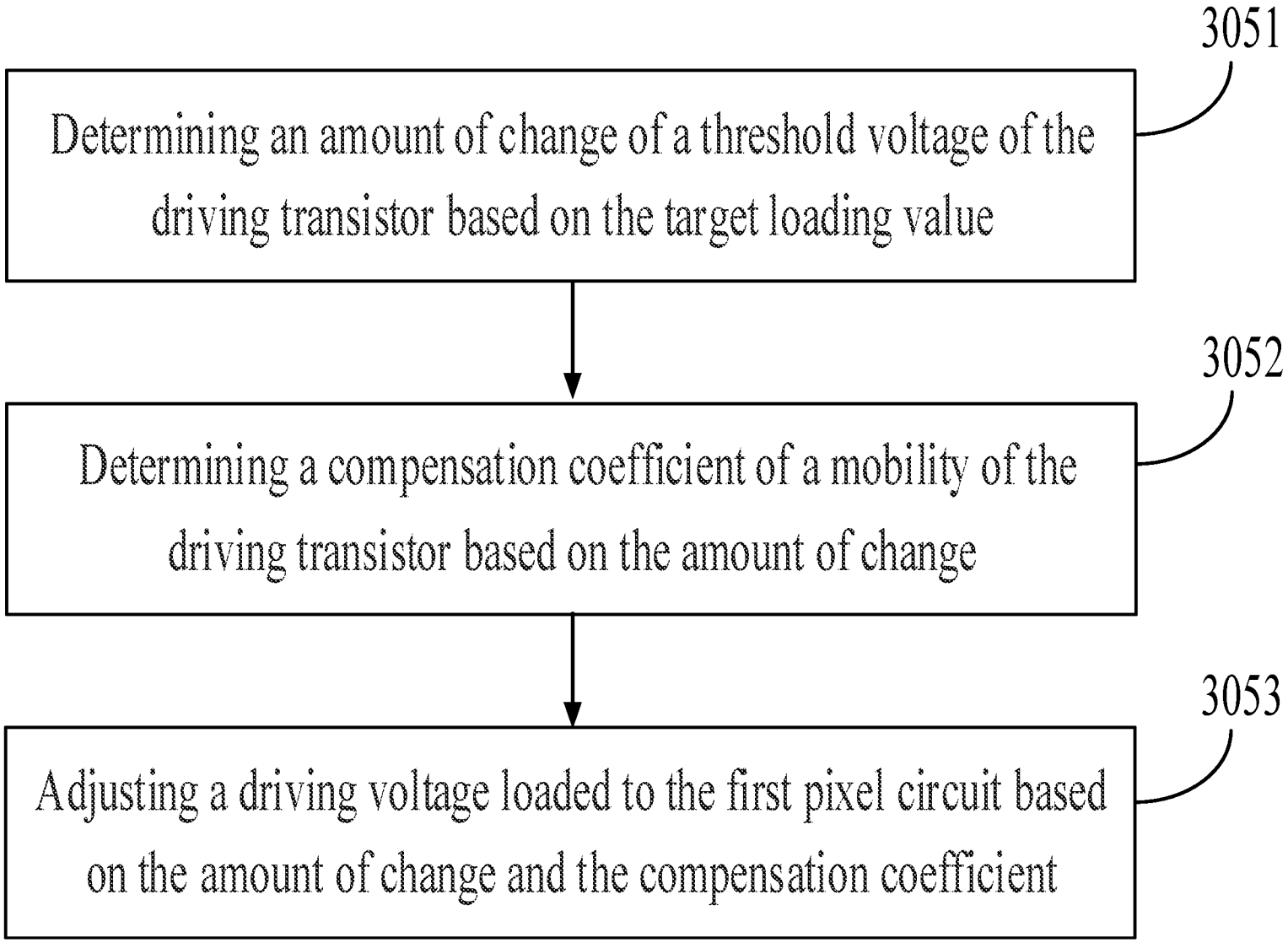
FIG. 11 is a flowchart of a method for adjusting a driving voltage based on a target loading value to compensate for the driving voltage according to an embodiment of the present disclosure.

Since the threshold voltage and the mobility of the driving transistor in the pixel circuit are the main factors affecting the charging ability of the pixel circuit, when the pixel circuit is compensated, the amount of change of the threshold voltage and the compensation coefficient of the mobility may be acquired, and the driving voltage loaded to the pixel circuit is adjusted in accordance with the amount of change of the threshold voltage and the compensation coefficient of the mobility and the mapping relationships of the threshold voltage and the mobility as a function of temperature, to adjust the driving voltage loaded to the pixel circuit. Optionally, as illustrated in FIG. 11, the implementation process of step 305 may include the following steps.

In step 3051, an amount of change of a threshold voltage of the driving transistor is determined based on the target loading value.

The amount of change of the threshold voltage of the driving transistor is a main factor causing the target loading value to change with respect to the initial loading value, and therefore, the difference between the target loading value and the initial loading value may be determined as the amount of change of the threshold voltage.

Illustratively, assuming that the initial loading value of the driving voltage is 5 V and the target loading value of the driving voltage is 5.01 V, the amount of change of the threshold voltage may be determined V1=5.01 V−5V=0.01 V.

In step 3052, a compensation coefficient of a mobility of the driving transistor is determined based on the amount of change.

Figure 12:
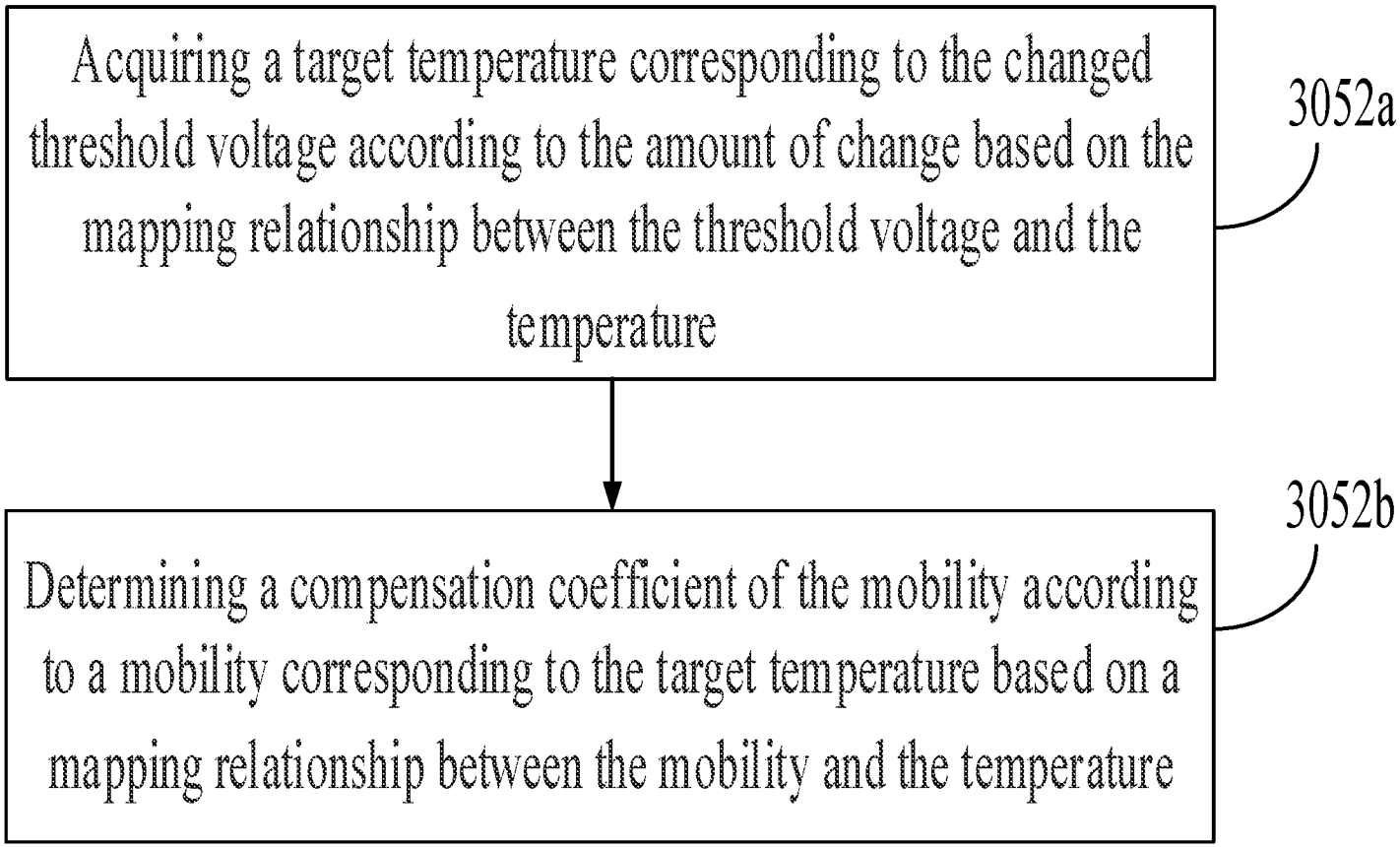
FIG. 12 is a flowchart of a method for determining a compensation coefficient of a mobility of a driving transistor based on an amount of change according to an embodiment of the present disclosure.

Since both the threshold voltage and the mobility change according to the temperature, and the tendencies of changes with temperature are the same, the changed threshold voltage may be determined according to the amount of change of the threshold voltage. Then, the temperature corresponding; to the changed threshold voltage may be determined by querying the pre-stored mapping relationship of the threshold voltage as a function of temperature, that is, the mapping relationship between the threshold voltage and the temperature. The temperature is the real-time temperature of the first pixel unit. Then, the compensation coefficient of the mobility may be determined by querying the mapping relationship of the mobility and with respect to temperature, that is, the mapping relationship between the mobility and the temperature, according to the real-time temperature, so that. As illustrated in FIG. 12, the implementation process of step 3052 may include the following steps.

In step 3052*a*, a target temperature corresponding to the changed threshold voltage is acquired according to the amount of change based on the mapping relationship between the threshold voltage and the temperature.

Optionally, the implementation of step 3052*a* may include determining a threshold voltage at the target temperature, that is, the changed threshold voltage, based on the amount of change. Then, according to the mapping relationship between the threshold voltage and the temperature, the target temperature corresponding to the changed threshold voltage is determined.

Figure 13:
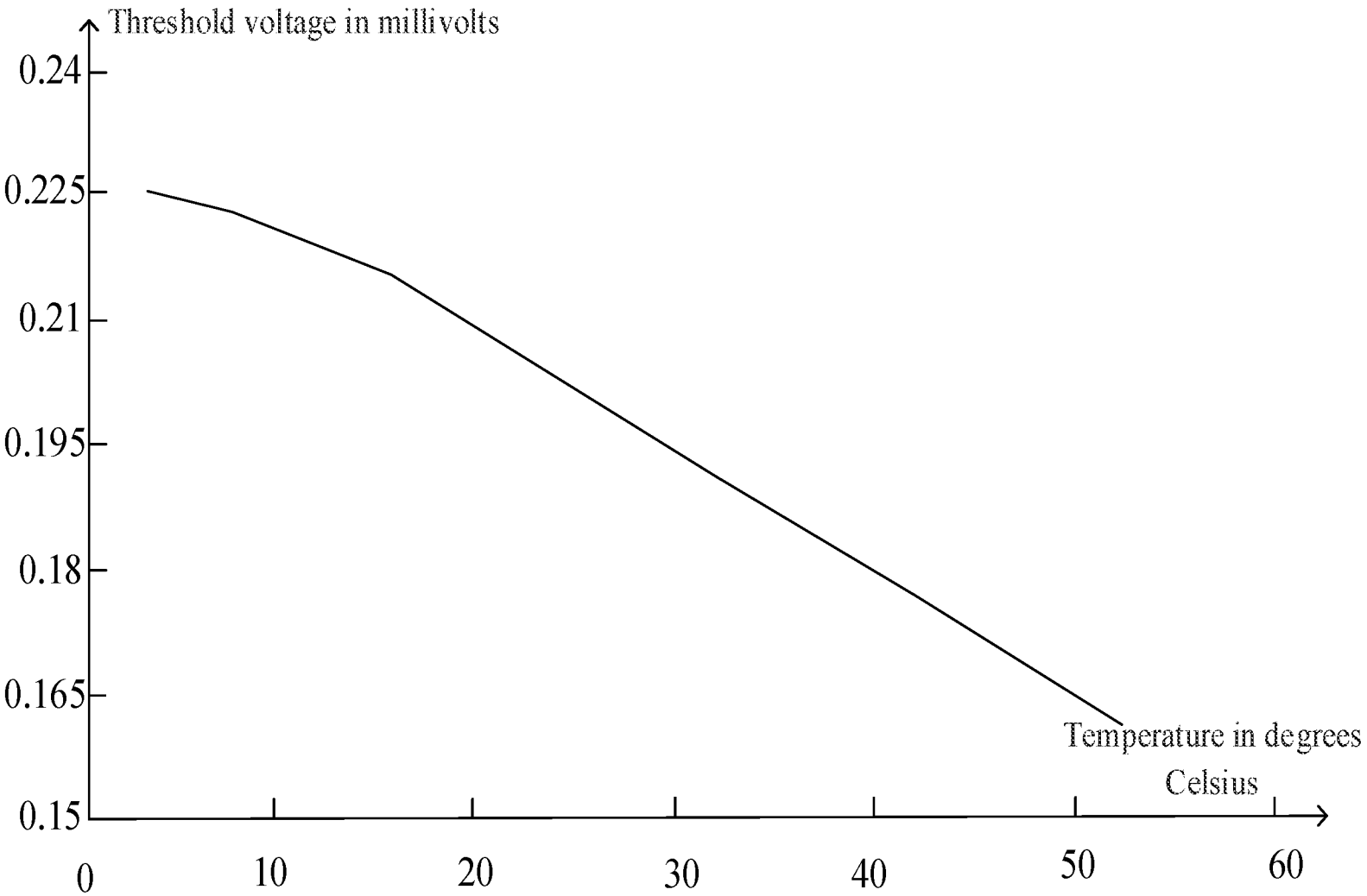
FIG. 13 is a schematic diagram of a mapping relationship between temperature and a threshold voltage according to an embodiment of the present disclosure.

Illustratively, FIG. 13 is a schematic diagram showing a mapping relationship between temperature and the threshold voltage. In FIG. 13, the abscissa indicates temperature in degrees Celsius, and the ordinate in FIG. 13 indicates the threshold voltage in millivolts. The initial value V0 of the threshold voltage is 0.2 V and the amount of change of the threshold voltage V1=0.01 V, then the changed threshold voltage V2=V1+V0=0.01 V+0.2 V=0.21 V may be determined based on the amount of change. By looking up the mapping relationship shown in FIG. 13 based on the changed threshold voltage V2, it is possible to determine that the target temperature is 20 degrees.

The mapping relationship between the threshold voltage and the temperature may be stored in advance in the voltage compensation device of the display panel. The mapping relationship may be acquired according to experiments. For example, the display panel may be separately controlled to maintain a plurality of temperatures. During the process of maintaining the display panel at a certain temperature and when the display panel is in a shutdown state, the first luminance control element in the first pixel unit is charged through the driving transistor in the first pixel unit. Then, when the driving transistor is in a cutoff state, the difference between the driving voltage supplied to the first pixel unit and the output voltage of the driving transistor is determined as an initial value of the threshold voltage at this temperature to obtain the initial values of the threshold voltage at a plurality of temperatures and establish a mapping relationship between each temperature and the initial value of the threshold voltage at that temperature. The implementation process of determining the initial value of the threshold voltage at each temperature may refer to the implementation process of step 3011*a* to step 3012*a*.

In step 3052*b*, a compensation coefficient of the mobility is determined according to a mobility corresponding to the target temperature based on a mapping relationship between the mobility and the temperature.

Optionally, the compensation coefficient K1 of the mobility may satisfy: K1=VS0/[K0×(VS1+K2)]. K0 is the initial value of the mobility, K2 is the mobility corresponding to the target temperature, VS0 is the second target value when determining the initial value of the mobility, and VS1 is a charging voltage of the first luminance control element when the first pixel circuit is loaded with a driving voltage having the first target value and the first luminance control element is charged such that the driving transistor in the first pixel circuit is in a cutoff state.

Figure 14:
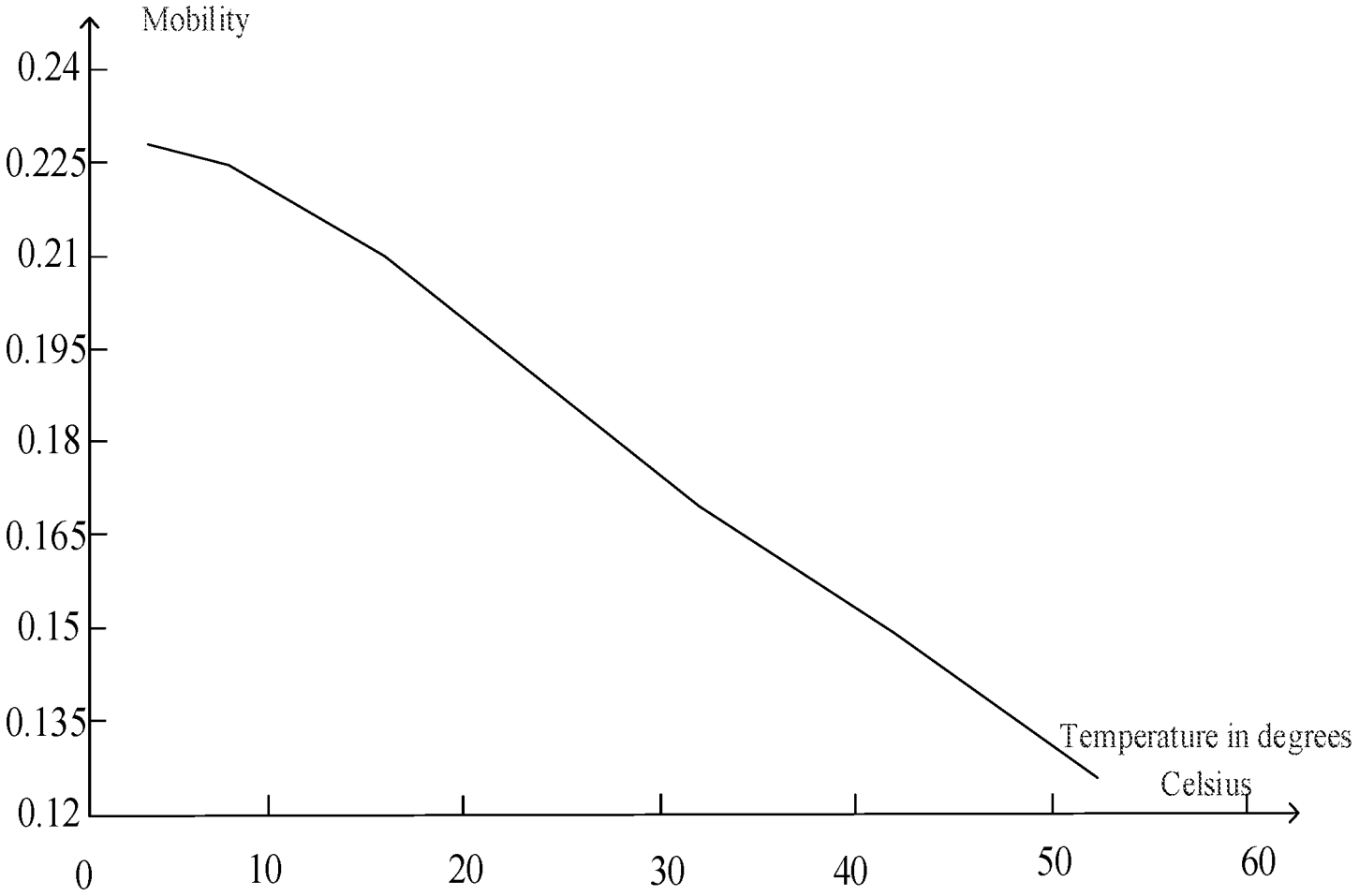
FIG. 14 is a schematic diagram of a mapping relationship between temperature and a mobility according to an embodiment of the present disclosure.

Exemplarily, assuming that FIG. 14 is a schematic curve showing a mapping relationship between temperature and mobility. In FIG. 14, the abscissa indicates temperature in degrees Celsius, and the ordinate in FIG. 14 indicates mobility. The target temperature is 20 degrees. By looking up the mapping relationship shown in FIG. 14 according to the target temperature, it may be determined that the mobility K2=0.198 corresponding to the target temperature. Assuming VS0=1.8V, VS1=1.5 V, K0=1.2, according to the relationship between the compensation coefficient and the mobility corresponding to the target temperature: the compensation coefficient of mobility K1=VS0/[K0×(VS+K2)]=1.8/[1.2×(1.5+0.198)]=0.88.

The mapping relationship between the mobility and the temperature may be stored in advance in the voltage compensation device of the display panel. The mapping relationship may be acquired according to experiments. For example, the display panel may be separately controlled to maintain a plurality of temperatures. During the process of maintaining the display panel at a certain temperature and when the display panel is in a shutdown state, a charging voltage of the first luminance control element after the first luminance control element is charged for a preset duration by the driving transistor in the first pixel unit. Then, the ratio of the second target value to the charging voltage is determined as the initial value of the mobility at the temperature to obtain initial values of the mobility at a plurality of temperatures and establish a mapping relationship between each temperature and an initial value of the mobility at the temperature. The implementation process of determining the initial value of the mobility at each temperature may refer to the implementation process of step 3011*b* to step 3012*h*.

In step 3053, a driving voltage loaded to the first pixel circuit is adjusted based on the amount of change and the compensation coefficient.

When performing step 3053, the amplitude of the adjusted driving voltage may be determined first, and then the driving voltage corresponding to the amplitude is supplied to the first pixel circuit where the driving transistor is disposed according to the adjusted amplitude. Optionally, the amplitude Vd1 of the adjusted driving voltage may satisfy: Vd1=K0×K1×Vd0+V0+V1. V1 is an amount of change of the threshold voltage, K1 is a compensation coefficient of the mobility, V0 is an initial value of the threshold voltage, K0 is an initial value of the mobility, and Vd0 is an amplitude of a driving voltage loaded to the first pixel circuit before the driving voltage is adjusted.

Illustratively, assuming that the amount of change of the threshold voltage is V1=0.01V, the compensation coefficient of the mobility is K1=0.88, the initial value of the threshold voltage is V0=0.2V, the initial value of the mobility is K0=1.2, and the amplitude of the driving voltage loaded to the first pixel circuit is Vd0=5 V before the driving voltage is adjusted, then the amplitude of the adjusted driving voltage may be acquired Vd1=K0×K1×Vd0+V0+V1=1.2×0.88×5 V+0.2 V+0.01 V=5.49 V. After determining the amplitude of the adjusted driving voltage, a driving voltage of 5.49V may be supplied to the first pixel circuit to overcome the influence of temperature on the electrical characteristics of the driving transistor, thereby improving the charging efficiency of the luminance control element through the transistor in the pixel circuit.

In summary, in the voltage compensation method according to the embodiment of the present disclosure, an initial parameter value and a plurality of target parameter values of a charging parameter of a pixel circuit is acquired respectively when the display panel is in a non-operating state and an operating state, a target loading value is determined according to the plurality of target parameter values, and then a driving voltage is adjusted according to the target loading value to compensate for the driving voltage. Since the target loading value is a loading value corresponding to the target parameter value closest to the initial parameter value among the plurality of target parameter values, and the charging parameter indicates a charging capability of the first pixel circuit, it may be determined that when the target loading value is provided to the pixel circuit, the charging capability of the pixel circuit is closest to the charging capability when the display panel is in an non-operating state. Compared with the related art, by adjusting the driving voltage of the pixel circuit according to the target loading value, the driving voltage may be compensated according to the actual charging capability of the pixel circuit, which may ensure the charging capability of the pixel circuit and ensure the charging efficiency of the pixel control circuit for the luminance control element.

When the voltage compensation method is loaded to an AMOLED display panel, since the charging efficiency of the luminance control element may be improved, display effects such as display uniformity of the AMOLED display panel may be correspondingly improved.

It should be noted that the sequence of the voltage compensation method steps according to the embodiments of the present disclosure may be appropriately adjusted, and the steps may also be correspondingly increased or decreased according to the situation, and the methods that may be easily conceived by those skilled familiar to the art within the technical scope of the present application are covered by the scope of protection of the present application and therefore will not be described again.

Figure 15:
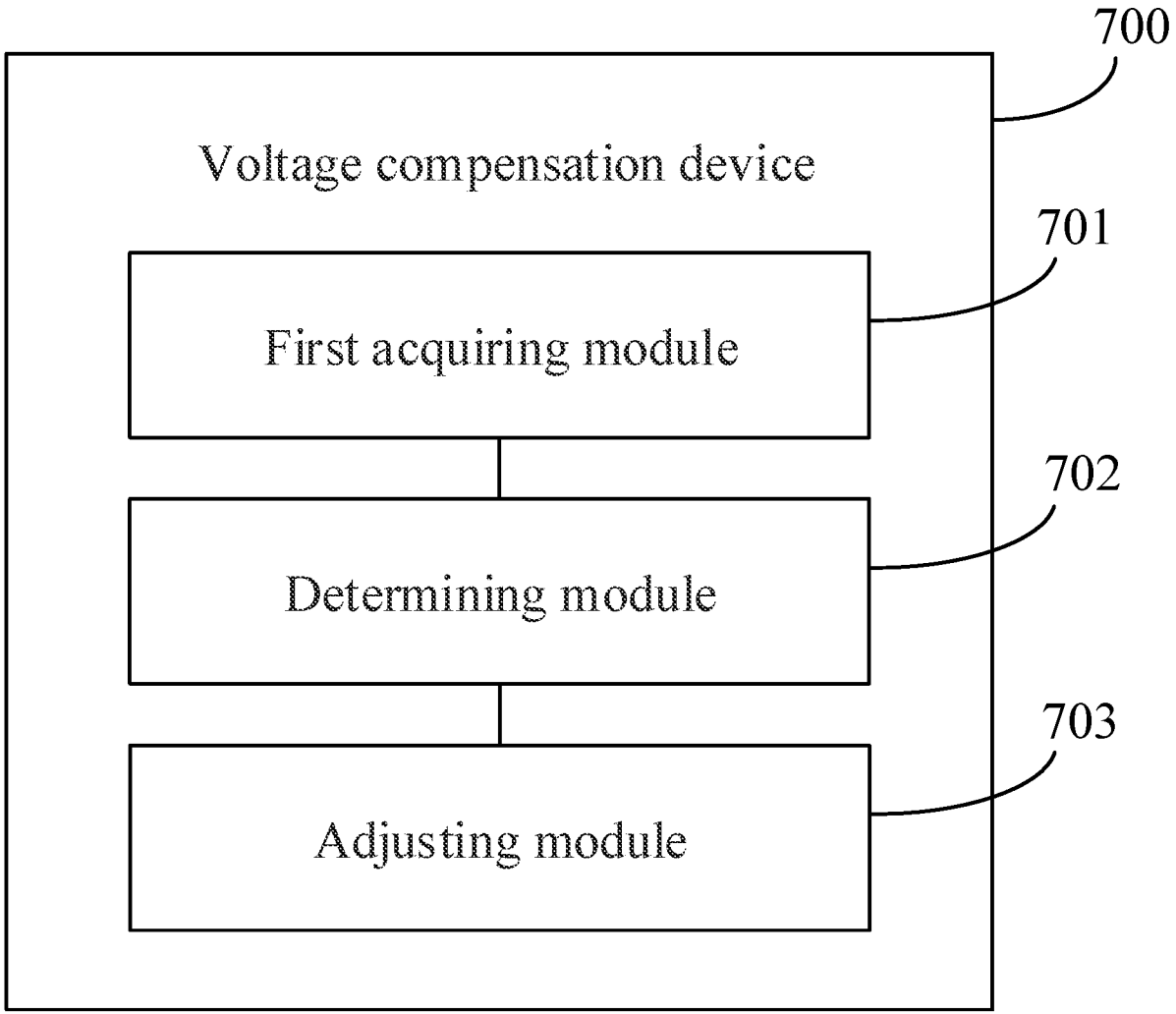
FIG. 15 is a schematic structural diagram of a voltage compensation device according to an embodiment of the present disclosure.

An embodiment of the present disclosure provides a voltage compensation device that may be used to implement the voltage compensation method provided by the above embodiments. Moreover, the voltage compensation device may be an integrated circuit or a processor or the like. For example, the voltage compensation device may be a time sequence controller or integrated in the time sequence controller. As illustrated in FIG. 15, the device 700 may include:

a first acquiring module 701, configured to acquire an initial parameter value of a charging parameter of a first pixel circuit in a first pixel unit when the display panel is in a non-operating state, wherein the charging parameter indicates a charging capability of the first pixel circuit, the initial parameter value is determined based on a charging voltage of a first luminance control element after loading a driving voltage having an initial loading value to the first pixel circuit to cause the first luminance control element in the first pixel unit to be charged for a target duration, and the first pixel unit is one of the plurality of pixel units;

wherein the first acquiring module 701 configured to acquire a plurality of target parameter values of the charging parameter of the first pixel circuit when the display panel is in an operating state, wherein at least one of the target parameter values is determined based on the charging voltage of the first luminance control element after loading a driving voltage having a drive loading value to the first pixel circuit to cause the first luminance control element in the first pixel unit to be charged for a target duration, and the plurality of target parameter values is determined based on different drive loading values;

a determining module 702, configured to determine a target loading value from a plurality of the drive loading values according to the plurality of target parameter values, wherein a difference between a target parameter value corresponding to the target loading value and the initial parameter value is greater than differences between other target parameter values and the initial parameter value; and an adjusting module 703, configured to adjust the driving voltage based on the target loading value to compensate for the driving voltage.

In summary, in the voltage compensation device according to the embodiment of the present disclosure, an initial parameter value and a plurality of target parameter values of a charging parameter of a pixel circuit is acquired by the first acquiring module respectively when the display panel is in a non-operating state and an operating state, a target loading value is determined by the determining module according to the plurality of target parameter values, and then a driving voltage is adjusted by the adjusting module according to the target loading value to compensate for the driving voltage. Since the target loading value is a loading value corresponding to the target parameter value closest to the initial parameter value among the plurality of target parameter values, and the charging parameter indicates a charging capability of the first pixel circuit, it may be determined that when the target loading value is provided to the pixel circuit, the charging capability of the pixel circuit is closest to the charging capability when the display panel is in an non-operating state. Compared with the related art, by adjusting the driving voltage of the pixel circuit according to the target loading value, the driving voltage may be compensated according to the actual charging capability of the pixel circuit, which may ensure the charging capability of the pixel circuit and ensure the charging efficiency of the pixel control circuit for the luminance control element.

Figure 16:
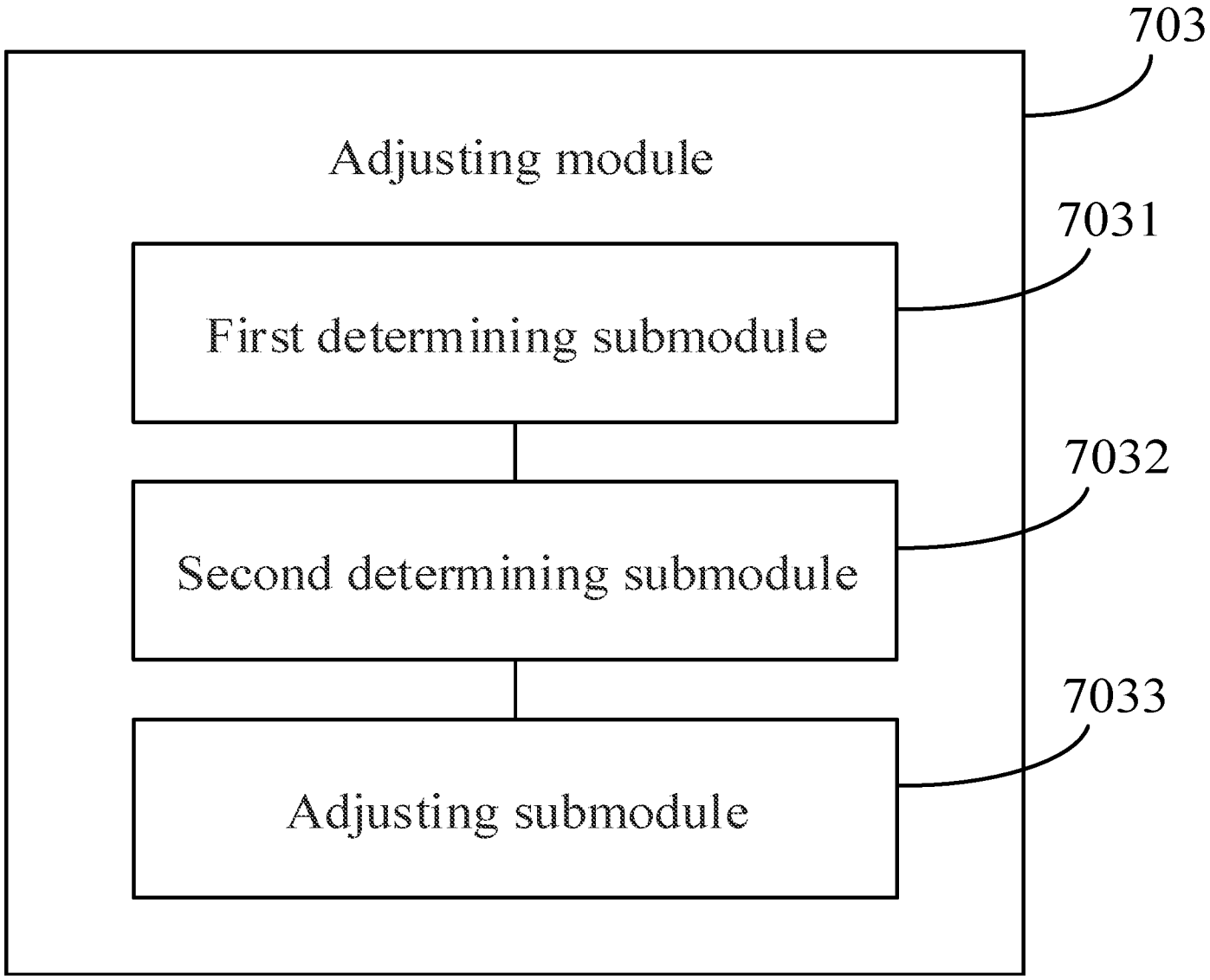
FIG. 16 is a schematic structural diagram of an adjusting module according to an embodiment of the present disclosure.

Optionally, the first pixel circuit may include a driving transistor configured to control whether to charge the first luminance control element. Accordingly, as illustrated in FIG. 16, the adjusting module 703 may include:

a first determining submodule 7031, configured to determine an amount of change of a threshold voltage of the driving transistor based on the target loading value;

a second determining submodule 7032, configured to determine a compensation coefficient of a mobility of the driving transistor based on the amount of change; and an adjusting submodule 7033, configured to adjust the driving voltage loaded to the first pixel circuit based on the amount of change and the compensation coefficient.

Optionally, the amount of change is a difference between the target loading value and the initial loading value.

Optionally, the second determining submodule 7032 is configured to:

acquire, based on a mapping relationship between the threshold voltage and temperature, a target temperature corresponding to the changed threshold voltage according to the amount of change; and;

acquire, based on a mapping relationship between the mobility and the temperature, a compensation coefficient of the mobility according to a mobility corresponding to the target temperature.

Optionally, the compensation coefficient K1 of the mobility satisfies: $K1=VS0/[K0\times(VS1+K2)]$;

where K0 is an initial value of the mobility, K2 is a mobility corresponding to the target temperature, and VS1 is the charging voltage of the first luminance control element when a driving voltage having a first target value is loaded to the first pixel circuit and the first luminance control element is charged such that the driving transistor charged in the first pixel circuit is in a cutoff state, and VS0 is a second target value when determining an initial value of the mobility.

Optionally, the amplitude Vd1 of the adjusted driving voltage satisfies: Vd1=K0×K1×Vd0+V0+V1.

where V1 is the amount of change, K1 is the compensation coefficient, V0 is the initial value of the threshold voltage, K0 is the initial value of the mobility, and Vd0 is the amplitude of the driving voltage loaded to the first pixel circuit before the driving voltage is adjusted.

Optionally, the first acquiring module 701 is configured to:

acquire a first charging voltage of the first luminance control element after loading a driving voltage having a first initial loading value to the first pixel circuit and charging the first luminance control element for a target duration;

acquire a second charging voltage of the first luminance control element after loading a driving voltage having a second initial loading value to the first pixel circuit and charging the first luminance control element for the target duration; and determine a ratio of the first charging voltage to the second charging voltage as an initial parameter value of the charging parameter.

Optionally, the first acquiring module 701 is configured to determine a target parameter value based on a set of loading values in a plurality of sets of loading values of the driving voltage, respectively, to obtain the plurality of target parameter values; wherein each set of loading values includes at least two drive loading values corresponding to at least two initial loading values when determining the initial parameter value, and at least two drive loading values in each set are the same with respect to the adjusted amplitude of the initial loading value.

Optionally, each set of loading values may include a first loading value and a second loading value; and the first acquiring module 701 is configured to:

acquire a third charging voltage of the first luminance control element after the driving time of the first pixel circuit is loaded to the first pixel circuit, and after charging the target time to the first luminance control element.

acquire a fourth charging voltage of the first luminance control element after the driving time of the first pixel circuit is loaded with the driving voltage of the second drive loading value to the first luminance control element.

determine a ratio of the third charging voltage to the fourth charging voltage as a target parameter value corresponding to a set of loading values.

In summary, in the voltage compensation device according to the embodiment of the present disclosure, an initial parameter value and a plurality of target parameter values of a charging parameter of a pixel circuit is acquired by the first acquiring module respectively when the display panel is in a non-operating state and an operating state, a target loading value is determined by the determining module according to the plurality of target parameter values, and then a driving voltage is adjusted by the adjusting module according to the target loading value to compensate for the driving voltage. Since the target loading value is a loading value corresponding to the target parameter value closest to the initial parameter value among the plurality of target parameter values, and the charging parameter indicates a charging capability of the first pixel circuit, it may be determined that when the target loading value is provided to the pixel circuit, the charging capability of the pixel circuit is closest to the charging capability when the display panel is in an non-operating state. Compared with the related art, by adjusting the driving voltage of the pixel circuit according to the target loading value, the driving voltage may be compensated according to the actual charging capability of the pixel circuit, which may ensure the charging capability of the pixel circuit and ensure the charging efficiency of the pixel control circuit for the luminance control element.

A person skilled in the art may clearly understand that for the convenience and brevity of the description, the specific working process of the foregoing device, module and sub-module may be referenced to the corresponding process in the foregoing method embodiment, and details are not described herein any further.

An embodiment of the present disclosure also provides a device for use in voltage compensation. The device may include a processor and a memory. The device performs the voltage compensation method according to the embodiment of the present disclosure when the processor executes a computer program stored in the memory.

An embodiment of the present disclosure also provides a storage medium, which may be a non-transitory computer-readable storage medium. When an instruction in a storage medium or a computer program is executed by a processor of a voltage compensation device, the voltage compensation device is capable of performing the voltage compensation method according to the embodiments of the present disclosure.

An embodiment of the present disclosure also provides a computer program product including instructions that, when being executed by a computer, cause the computer to perform the voltage compensation method according to the embodiments of the present disclosure.

Described above are only exemplary embodiments of the present disclosure, and are not intended to limit the present disclosure. Within the spirit and principles of the disclosure, any modifications, equivalent substitutions, improvements or the like are within the protection scope of the present disclosure.

What is claimed is:

1. A voltage compensation method for a display panel, the display panel comprising a plurality of pixel units, at least one of the pixel units comprising a pixel circuit and a light-emitting diode; the method comprising:

acquiring an initial parameter value of a charging parameter of a first pixel circuit in a first pixel unit when the display panel is in a non-operating state, wherein the charging parameter is to indicate a charging capability of the first pixel circuit, the initial parameter value is determined based on a charging voltage of a first light-emitting diode after loading a driving voltage having an initial loading value to the first pixel circuit to cause the first light-emitting diode in the first pixel unit to be charged for a target duration, and the first pixel unit one of the plurality of pixel units;

acquiring a plurality of target parameter values of the charging parameter of the first pixel circuit when the display panel is in an operating state, wherein at least one of the target parameter values is determined based on the charging voltage of the first light-emitting diode after loading a driving voltage having a drive loading value to the first pixel circuit to cause the first light-emitting diode in the first pixel unit to be charged for a target duration, and the plurality of target parameter values is determined based on different drive loading values;

determining a target loading value from a plurality of the drive loading values according to the plurality of target parameter values, wherein a difference between a target parameter value corresponding to the target loading value and the initial parameter value is greater than differences between other target parameter values and the initial parameter value; and adjusting the driving voltage based on the target loading value to compensate for the driving voltage.

2. The method according to claim 1, wherein the first pixel circuit comprises a driving transistor for controlling whether to charge the first light-emitting diode, and the adjusting the driving voltage based on the target loading value to compensate for the driving voltage comprises:

determining an amount of change of a threshold voltage of the driving transistor based on the target loading value;

determining a compensation coefficient of a mobility of the driving transistor based on the amount of change; and adjusting the driving voltage loaded to the first pixel circuit based on the amount of change and the compensation coefficient.

3. The method according to claim 2, wherein the amount of change is a difference between the target loading value and the initial loading value.

4. The method according to claim 2, wherein the determining a compensation coefficient of a mobility of the driving transistor based on the amount of change comprises:

acquiring, based on a mapping relationship between the threshold voltage and temperature, a target temperature corresponding to the changed threshold voltage according to the amount of change; and acquiring, based on a mapping relationship between the mobility and the temperature, a compensation coefficient of the mobility according to a mobility corresponding to the target temperature.

5. The method according to claim 4, wherein the compensation coefficient K1 of the mobility satisfies: $K1=VS0/[K0\times(VS1+K2)]$;

where K0 is an initial value of the mobility, K2 is the mobility corresponding to the target temperature, VS1 is a charging voltage of the first light-emitting diode when a driving voltage having a first target value is loaded to the first pixel circuit and the first light-emitting diode is charged such that the driving transistor in the first pixel circuit is in a cutoff state, VS0 is a second target value used to determine the initial value of the mobility, and the first target value is a sum of the second target value and an initial value of the threshold voltage.

6. The method according to claim 2, wherein an amplitude Vd1 of the adjusted driving voltage satisfies: $Vd1=K0\times K1\times Vd0+V0+V1$;

where V1 is the amount of change, K1 is the compensation coefficient, V0 is an initial value of the threshold voltage, K0 is an initial value of the mobility, and Vd0 is an amplitude of the driving voltage loaded to the first pixel circuit before adjusting the driving voltage.

7. The method according to claim 1, wherein the acquiring an initial parameter value of a charging parameter of a first pixel circuit in a first pixel unit comprises:

acquiring a first charging voltage of the first light-emitting diode after loading a driving voltage having a first initial loading value to the first pixel circuit and charging the first light-emitting diode for a target duration;

acquiring a second charging voltage of the first light-emitting diode after loading a driving voltage having a second initial loading value to the first pixel circuit and charging the first light-emitting diode for the target duration; and determining a ratio of the first charging voltage to the second charging voltage as an initial parameter value of the charging parameter.

8. The method according to claim 1, wherein the acquiring a plurality of target parameter values of the charging parameter of the first pixel circuit comprises:

determining a target parameter value based on a set of loading values in a plurality of sets of loading values of the driving voltage, respectively, to obtain the plurality of target parameter values;

wherein each set of loading values comprises at least two drive loading values corresponding to at least two initial loading values when determining the initial parameter value, and at least two drive loading values in each set are the same with respect to the adjusted amplitude of the initial loading value.

9. The method according to claim 8, wherein each set of loading values comprises a first drive loading value and a second drive loading value; and the determining a target parameter value based on a set of loading values in a plurality of sets of loading values of the drive voltage, respectively, comprises:

acquiring a third charging voltage of the first light-emitting diode after loading a driving voltage having the first drive loading value to the first pixel circuit and charging the first light-emitting diode for a target duration;

acquiring a fourth charging voltage of the first light-emitting diode after loading a driving voltage having the second drive loading value to the first pixel circuit and charging the first light-emitting diode for the target duration; and determining a ratio of the third charging voltage to the fourth charging voltage as a target parameter value corresponding to a set of loading values.

10. The method according to claim 9, wherein the first pixel circuit comprises a driving transistor for controlling whether to charge the first light-emitting diode;

the acquiring an initial parameter value of a charging parameter of a first pixel circuit in a first pixel unit comprises:

acquiring a first charging voltage of the first light-emitting diode after loading a driving voltage having a first initial loading value to the first pixel circuit and charging the first light-emitting diode for a target duration;

acquiring a second charging voltage of the first light-emitting diode after loading a driving voltage having a second initial loading value to the first pixel circuit and charging the first light-emitting diode for the target duration; and determining a ratio of the first charging voltage to the second charging voltage as the initial parameter value of the charging parameter; and the adjusting the driving voltage based on the target loading value to compensate for the driving voltage comprises:

determining a difference between the target loading value and the initial loading value as an amount of change of a threshold voltage of the driving transistor;

acquiring, based on a mapping relationship between the threshold voltage and temperature, a target temperature corresponding to the changed threshold voltage according to the amount of change; and acquiring, based on a mapping relationship between the mobility and the temperature, a compensation coefficient of the mobility according to a mobility corresponding to the target temperature, where the compensation coefficient K1 of the mobility satisfies: K1=VS0/[K0×(VS1+) K2)];

adjusting the driving voltage loaded to the first pixel circuit based on the amount of change and the compensation coefficient K1, wherein the amplitude Vd1 of the adjusted driving voltage satisfies: Vd1=K0×K1×Vd0+V0+V1;

wherein K0 is an initial value of the mobility, K2 is the mobility corresponding to the target temperature, VS1 is a charging voltage of the first light-emitting diode when a driving voltage having a first target value is loaded to the first pixel circuit and the first light-emitting diode is charged such that the driving transistor in the first pixel circuit is in a cutoff state, VS0 is a second target value used to determine the initial value of the mobility, the first target value is a sum of the second target value and an initial value of the threshold voltage, V1 is the amount of change, V0 is an initial value of the threshold voltage, and Vd0 is an amplitude of the driving voltage loaded to the first pixel circuit before adjusting the driving voltage.

11. A voltage compensation device for a display panel, the display panel comprising a plurality of pixel units, at least one of the pixel units comprising a pixel circuit and a light-emitting diode; the device comprising a processor and a memory, wherein the processor executes a computer program stored in the memory for:

acquiring an initial parameter value of a charging parameter of a first pixel circuit in a first pixel unit when the display panel is in a non-operating state, wherein the charging parameter indicates a charging capability of the first pixel circuit, the initial parameter value is determined based on a charging voltage of a first light-emitting diode after loading a driving voltage having an initial loading value to the first pixel circuit to cause the first light-emitting diode in the first pixel unit to be charged for a target duration, and the first pixel unit is one of the plurality of pixel units;

acquiring a plurality of target parameter values of the charging parameter of the first pixel circuit when the display panel is in an operating state, wherein at least one of the target parameter values is determined based on the charging voltage of the first light-emitting diode after loading a driving voltage having a drive loading value to the first pixel circuit to cause the first light-emitting diode in the first pixel unit to be charged for a target duration, and the plurality of target parameter values is determined based on different drive loading values;

determining a target loading value from a plurality of the drive loading values according to the plurality of target parameter values, wherein a difference between a target parameter value corresponding to the target loading value and the initial parameter value is greater than differences between other target parameter values and the initial parameter value; and adjusting the driving voltage based on the target loading value to compensate for the driving voltage.

12. The device according to claim 11, wherein the first pixel circuit comprises a driving transistor for controlling whether to charge the first light-emitting diode; and the adjusting the driving voltage based on the target loading value to compensate for the driving voltage comprises:

determining an amount of change of a threshold voltage of the driving transistor based on the target loading value;

determining a compensation coefficient of a mobility of the driving transistor based on the amount of change; and adjusting the driving voltage loaded to the first pixel circuit based on the amount of change and the compensation coefficient.

13. The device according to claim 12, wherein the amount of change is a difference between the target loading value and the initial loading value.

14. The device according to claim 12, wherein the processor executes the computer program stored in the memory for:

acquiring, based on a mapping relationship between the threshold voltage and temperature, a target temperature corresponding to the changed threshold voltage according to the amount of change; and acquiring, based on a mapping relationship between the mobility and the temperature, a compensation coefficient of the mobility according to a mobility corresponding to the target temperature.

15. The device according to claim 12, wherein an amplitude Vd1 of the adjusted driving voltage satisfies: Vd1=K0×K1×Vd0+V0+V1;

where V1 is the amount of change, K1 is the compensation coefficient, V0 is an initial value of the threshold voltage, K0 is an initial value of the mobility, and Vd0 is an amplitude of the driving voltage loaded to the first pixel circuit before adjusting the driving voltage.

16. The device according to claim 11, wherein the processor executes the computer program stored in the memory for:

acquiring a first charging voltage of the first light-emitting diode after loading a driving voltage having a first initial loading value to the first pixel circuit and charging the first light-emitting diode for a target duration;

acquiring a second charging voltage of the first light-emitting diode after loading a driving voltage having a second initial loading value to the first pixel circuit and charging the first light-emitting diode for the target duration; and determining a ratio of the first charging voltage to the second charging voltage as an initial parameter value of the charging parameter.

17. The device according to claim 11, wherein the processor executes the computer program stored in the memory for:

determining a target parameter value based on a set of loading values in a plurality of sets of loading values of the driving voltage, respectively, to obtain the plurality of target parameter values;

wherein each set of loading values comprises: at least two drive loading values corresponding to at least two initial loading values when determining the initial parameter value, and at least two drive loading values in each set are the same with respect to the adjusted amplitude of the initial loading value.

18. The device according to claim 17, wherein each set of loading values comprises a first drive loading value and a second drive loading value; and determining a target parameter value based on a set of loading values in a plurality of sets of loading values of the drive voltage, respectively, comprises:

acquiring a third charging voltage of the first light-emitting diode after loading a driving voltage having the first drive loading value to the first pixel circuit and charging the first light-emitting diode for a target duration;

acquiring a fourth charging voltage of the first light-emitting diode after loading a driving voltage having the second drive loading value to the first pixel circuit and charging the first light-emitting diode for the target duration; and determining a ratio of the third charging voltage to the fourth charging voltage as a target parameter value corresponding to a set of loading values.

19. A non-transitory computer-readable storage medium having stored therein a computer program, the computer program instructing a voltage compensation device to perform the voltage compensation method of claim 1.

20. A display device, comprising a display panel and a voltage compensation device; the display panel comprising a plurality of pixel units, and at least one of the pixel units comprising a pixel circuit and a light-emitting diode;

the voltage compensation device comprising a processor and a memory, wherein the processor executes a computer program stored in the memory for:

acquiring an initial parameter value of a charging parameter of a first pixel circuit in a first pixel unit when the display panel is in a non-operating state, wherein the charging parameter indicates a charging capability of the first pixel circuit, the initial parameter value is determined based on a charging voltage of a first light-emitting diode after loading a driving voltage having an initial loading value to the first pixel circuit to cause the first light-emitting diode in the first pixel unit to be charged for a target duration, and the first pixel unit is one of the plurality of pixel units;

acquiring a plurality of target parameter values of the charging parameter of the first pixel circuit when the display panel is in an operating state, wherein at least one of the target parameter values is determined based on the charging voltage of the first light-emitting diode after loading a driving voltage having a drive loading value to the first pixel circuit to cause the first light-emitting diode in the first pixel unit to be charged for a target duration, and the plurality of target parameter values is determined based on different drive loading values;

determining a target loading value from a plurality of the drive loading values according to the plurality of target parameter values, wherein a difference between a target parameter value corresponding to the target loading value and the initial parameter value is greater than differences between other target parameter values and the initial parameter value; and adjusting the driving voltage based on the target loading value to compensate for the driving voltage.

* * * * *